US008973223B2

(12) United States Patent
Blackford et al.

(10) Patent No.: US 8,973,223 B2
(45) Date of Patent: Mar. 10, 2015

(54) WEATHER RESISTANT SLIDE FASTENERS

(75) Inventors: Woody Blackford, Portland, OR (US); Gary Davis, Oxford, NC (US)

(73) Assignee: Columbia Sportswear North America, Inc., Portland, OR (US)

( * ) Notice: Subject to any disclaimer, the term of this patent is extended or adjusted under 35 U.S.C. 154(b) by 944 days.

(21) Appl. No.: 12/645,359

(22) Filed: Dec. 22, 2009

(65) Prior Publication Data

US 2010/0154179 A1 Jun. 24, 2010

Related U.S. Application Data

(60) Provisional application No. 61/139,861, filed on Dec. 22, 2008.

(51) Int. Cl.
*A44B 19/26* (2006.01)
*A44B 19/16* (2006.01)
*A44B 19/32* (2006.01)

(52) U.S. Cl.
CPC ..... *A44B 19/26* (2013.01); *A44B 19/32* (2013.01)
USPC ..... 24/427; 24/415

(58) Field of Classification Search
CPC ..... A44B 19/32; A44B 19/28
USPC ..... 24/388, 389, 393, 397, 398, 405, 426, 24/432, 436, 427
See application file for complete search history.

(56) References Cited

U.S. PATENT DOCUMENTS

| | | | | |
|---|---|---|---|---|
| 3,162,917 | A * | 12/1964 | Bair | 24/389 |
| 3,883,381 | A | 5/1975 | Thaeler | |
| 4,455,722 | A * | 6/1984 | Oda | 24/427 |
| 5,329,674 | A * | 7/1994 | Tomita et al. | 24/418 |
| 5,386,616 | A | 2/1995 | Norvell | |
| 5,628,094 | A * | 5/1997 | Mizuno | 24/428 |
| 5,898,979 | A * | 5/1999 | Hamada | 24/418 |
| 6,490,770 | B1 * | 12/2002 | Matsuda et al. | 24/427 |
| 6,497,014 | B2 * | 12/2002 | Neugebauer | 24/427 |
| 6,530,132 | B2 * | 3/2003 | Yamagishi et al. | 24/427 |
| 7,257,868 | B2 * | 8/2007 | Yoneshima | 24/432 |
| 2002/0050030 | A1 | 5/2002 | Takasawa | |
| 2003/0019085 | A1 | 1/2003 | Loglisci | |
| 2008/0066270 | A1 * | 3/2008 | Takazawa et al. | 24/439 |
| 2008/0086851 | A1 * | 4/2008 | Miyazaki | 24/426 |

FOREIGN PATENT DOCUMENTS

| | | |
|---|---|---|
| CN | 1078125 | 11/1993 |
| CN | 1147356 | 4/1997 |
| CN | 1415256 | 5/2003 |

(Continued)

*Primary Examiner* — Robert J Sandy

(74) *Attorney, Agent, or Firm* — Schwabe, Williamson & Wyatt, P.C.

(57) ABSTRACT

Embodiments provide a weather resistant slide fastener with a modified slider body including a top control rib and tightly controlled inner dimensions. In embodiments, a water-resistant coating and/or an adhesive may be applied to the zipper tape, resulting in a highly water-resistant zipper and finished garment. Embodiments further provide a slider body that may accommodate longitudinal edge portions of the outer layer of fabric, allowing the edges of the fabric to be brought into close proximity/contact, substantially covering the zipper teeth and minimizing ingress of water and/or wind through the zipper tape. Additional embodiments provide methods of manufacturing and installing weather resistant slide fasteners.

14 Claims, 18 Drawing Sheets

(56) References Cited

FOREIGN PATENT DOCUMENTS

| | | |
|---|---|---|
| EP | 1192871 | 4/2002 |
| EP | 1201144 | 5/2002 |
| JP | S33-005328 | 7/1958 |
| JP | S44-023769 | 8/1969 |
| JP | S57-29303 | 2/1982 |
| JP | H4-138304 | 12/1992 |
| JP | 09-037817 | 2/1997 |
| JP | 2002-101917 | 4/2002 |
| JP | 2002-525143 | 8/2002 |
| JP | 2005-511419 | 4/2005 |
| JP | 2006-015069 | 1/2006 |
| JP | 2007089898 | 4/2007 |
| SU | 596214 | 3/1978 |

* cited by examiner

WEATHER RESISTANT SLIDE FASTENERS

CROSS REFERENCE TO RELATED APPLICATIONS

The present application claims priority to U.S. Provisional Application No. 61/139,861, filed Dec. 22, 2008, entitled "Slide Fastener Slider for Moisture Resistant Application," the entire disclosure of which is hereby incorporated by reference in its entirety.

TECHNICAL FIELD

Embodiments herein relate to the field of fasteners, and, more specifically, to weather resistant slide fasteners.

BACKGROUND

The moisture resistance of articles such as garments is affected by the number and types of openings in the garment. Ideally, a water-resistant garment should be comfortable, easy to put on and take off, and allow freedom of movement. While using a zipper for a garment closure makes the garment easy to put on and take off, the zipper can reduce the water resistance of an otherwise water-resistant garment and can impact the wearer's comfort and mobility.

Slide fasteners, such as zippers, are commonly used in the garment industry. Typical zippers for jackets and other outerwear comprise metal zippers, molded zippers, and coil-type zippers. Zippers used in garments tend to be of a larger size such as a number 5, 6, or 7. Coil-type zippers are preferred for moisture resistant garments due to their strength, imperviousness to corrosion from moisture, and ease of sewing into garments.

Various features are sometimes added to conventional slide fasteners or to articles with such fasteners in order to enhance water resistance. For example, a flap may be added behind the slide fastener (on the inside of the article or garment) to physically block the penetration of water beyond the flap. This fails to prevent wetting of the stringers and teeth from the outside and can result in thickening/bulkiness of the article along the line of the fastener, which may be especially undesirable in articles such as garments. Alternatively, a water resistant coating is sometimes added to the outside of a zipper tape. While such coatings may limit the penetration of water through the tape, they do not prevent penetration of water through the interlocked teeth. It is possible to apply a coating that covers the zipper teeth. But water resistant coatings can cause stiffness of the zipper/slide fastener, resulting in an increased difficulty of operation and an unattractive appearance in articles such as garments. In addition, the repeated operation of the slider to open and close the fastener tends to abrade and/or displace the coating, resulting in the formation of a gap over the engaged teeth. This gap allows water to penetrate through the zipper teeth. Continued use of the fastener further degrades the coating and widens the gap, decreasing the effectiveness of the coating and the physical appearance of the fastener and article over time.

An example of prior art moisture resistant zippers with coated zipper chains is disclosed in U.S. Pat. No. 6,105,214. This patent discloses a zipper chain that is coated with a water resistant polyurethane layer and the method of making such chain. Zipper chain made using this method is more rigid due to the coating layer. The coating layer is pushed aside by the slider body of the zipper during normal operation of the zipper. This allows water to migrate directly through the zipper teeth at the point on the chain where the slider is located as well as some distance in either direction from the slider. In addition, repeated operation of the slider degrades the mating edges of the polyurethane layer over time, which can allow water to migrate directly through the zipper teeth along the length of the zipper chain.

Typically, manufacturers of articles that use zippers, such as garment manufacturers, purchase pre-made zipper tapes from zipper manufacturers and then mount each zipper tape to an article of clothing, such as by sewing or using adhesive films. If an adhesive film is used, it must be precisely cut (for example, using laser cutting) to accommodate the opening in the article so that adhesive is not visible between the edges of the upper layer of the finished article. Since the size of a zipper opening can vary from article to article, a manufacturer of articles that use zippers may need to cut adhesive films of various sizes to accommodate the various sizes and measurements of zipper tapes. This not only increases costs, but also complicates the garment manufacturing process.

There are typically a few general types of slide fastener construction. In a conventional non-invisible slide fastener, for example, a slider body is disposed on the exterior of the zipper tape and generally includes lateral rails to guide the coil/teeth into the slider. The top plate is connected to a bottom plate by a post that forms a rounded or diamond shape in plan view and is used to guide the zipper teeth into the slider body towards the joining area. The bottom plate generally includes a control rib to guide the zipper teeth/coils within the slider body and/or to apply pressure to the zipper teeth. This bottom control rib is shaped to separate the zipper tapes and lift the teeth/coil of each stringer into the proper orientation for engagement with the teeth/coil of the opposing stringer.

In a typical non-invisible nylon coil slide fastener, a nylon coil that forms a row of teeth is sewn to an upper surface of a strip of material (the stringer). When stringers are sewn into an article, such as a garment, the zipper teeth face outwards and the smooth (non-coil) lower surface of each stringer faces inwards toward the interior of the article. Even when the slide fastener is closed, small spaces between the interlocked teeth and the seams between the stringers and the surrounding fabric can allow water and/or air to pass from the front side to the back side of the zipper.

In contrast to the non-invisible nylon coil slide fastener, the nylon coil of a typical invisible slide fastener is coupled to the lower surface of the stringer. Again, even when the slide fastener is closed, small spaces between the interlocked teeth and the seams between the stringers and the surrounding fabric allow penetration of water and/or air through the fastener. Features added to conventional non-invisible slide fasteners may be added to invisible slide fasteners, with the same disadvantages. In addition, the top plate in the conventional invisible slide fastener slider causes the adjacent edges of the overlying fabric/material or coating to fold, bunch and/or separate as the bail moves between them during operation of the slide fastener. Over time, this wearing of the edges by the bail increases the size of the gap and can cause separation of the zipper tape from an overlying layer such as fabric, adhesive, a coating, etc.

Conventional slide fasteners may be installed in an article by various methods such as stitching/sewing or by use of an adhesive. The stringers may also be coated with a water resistant coating, as discussed above. However, the application of adhesive or coatings to zipper tapes (i.e. stringers coupled to teeth or coils) currently requires a post-manufacturing process in which a sheet of adhesive/coating is cut to match the perimeter of the zipper tape. The cutout must include an opening that matches the shape of the opening of the exposed portion of the zipper tape. The opening is generally at least the width of the slider body in order to prevent jamming of the slider. The additional steps required for post-manufacturing application of adhesives/coatings increases the expense and time required to prepare a slide fastener for installation into an article. Furthermore, this leaves a portion of the zipper tape exposed to the elements and reduces the weather resistance of the finished article.

BRIEF DESCRIPTION OF THE DRAWINGS

Embodiments will be readily understood by the following detailed description in conjunction with the accompanying drawings. Embodiments are illustrated by way of example and not by way of limitation in the Figures of the accompanying drawings.

DETAILED DESCRIPTION OF DISCLOSED EMBODIMENTS

Figure 1:
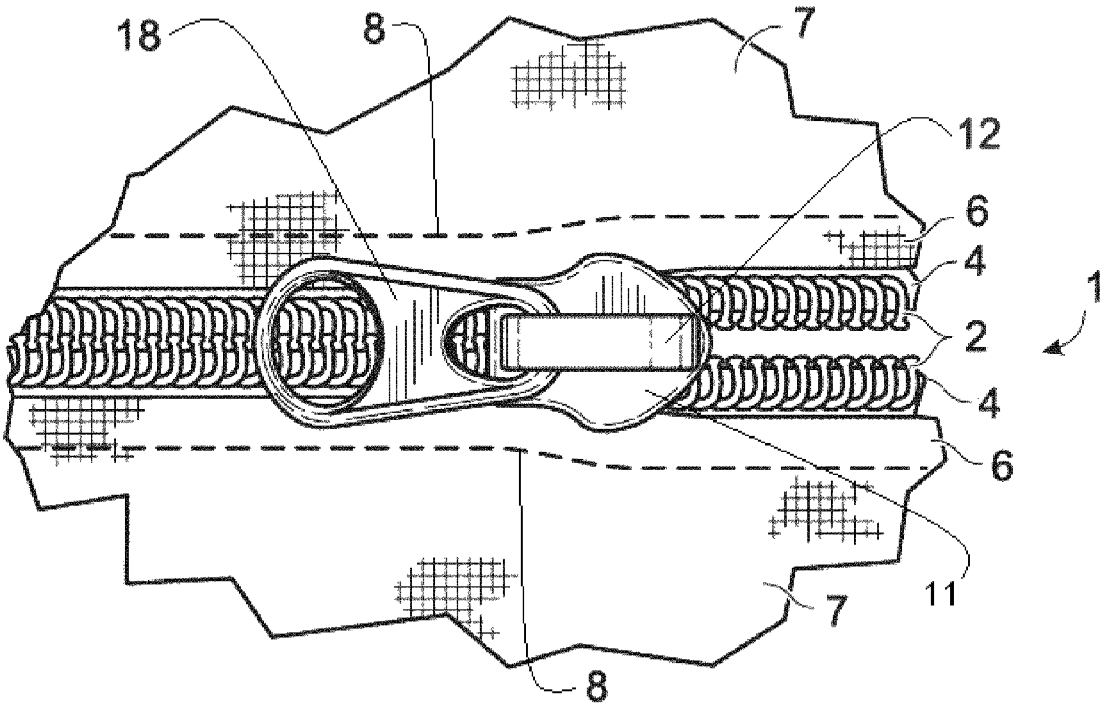
FIGURE 1 (PRIOR ART)
FIG. 1 shows a plan view of a conventional non-invisible slide fastener assembly.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

The terms "slide fastener" and "zipper" may be used interchangeably herein to refer to a fastening device comprising a slider and rows of tracks/teeth/coils that can be reversibly interlocked by moving the slider along the rows, with the tracks/teeth/coils becoming interlocked or separated within a portion of the slider. "Slide fastener" or "zipper" is intended to encompass any type of slide fastener known in the art or to be developed, including but not limited to a coil/spiral zipper, a nylon zipper, a molded plastic zipper, a molded teeth zipper, a vision zipper, a metal zipper, a plastic zipper, etc. Slide fasteners/zippers described herein are intended to encompass open-ended slide fasteners (e.g. open top with closed bottom, closed top with open bottom, open top with open bottom), closed-ended slide fasteners, and concealed slide fasteners (i.e. spiral coupled to underside of stringer, or spirals coupled to inner edges of stringers and stringers pleated/folded to position the spirals underneath the outer faces of the stringers). In some embodiments, a slide fastener/zipper may include two or more sliders. The term "zipper tape" may be used to refer to stringers or coupling flanges coupled to teeth/coils.

As used herein, "teeth," "teeth/coils", "coils," "zipper teeth" and "zipper coils" may be used interchangeable to refer to any repeating elements of any type that are configured to form an interlocking chain in a slide fastener. "Stringer" may refer to any material to which "teeth" are coupled. "Teeth" may be continuous or semi-continuous elements (e.g. spiral coils, ladder coils) or individual elements (e.g. pegs/teeth). Teeth may be coupled directly to one another and/or coupled to any portion of a stringer, such as along an edge and/or along an upper or lower surface of the stringer. For example, in an "invisible zipper," a coil may be coupled to a lower surface of a stringer proximal to an inner edge of the stringer, such that the teeth are not visible or are minimally visible when viewing the upper surface of the stringer. Teeth may be formed/manufactured as an integral portion of a stringer (e.g. woven/knitted into the stringer during stringer manufacture). Alternatively, teeth may be constructed separately from the stringer and/or added to a stringer by clamping, injection molding, sewing, gluing, weaving, or by any other means known in the art. Teeth may comprise metal, nylon, ceramic, plastic, one or more polymers, polyester, polyvinylchloride, etc. Teeth and/or stringers may be coated before, during, or after manufacture with a polymer (e.g. polyurethane, polyvinylchloride, etc.) or other suitable substance to impart moisture resistance and/or to smooth one or more surfaces of the teeth.

In various embodiments, methods, apparatuses, and systems for weather resistant slide fasteners are provided. Embodiments herein provide slide fasteners that are easy to operate, yet maintain moisture resistance in extreme conditions without degrading over time. Embodiments herein further provide components of such slide fasteners, methods of constructing/using weather resistant slide fasteners, and fastening systems with such weather resistant features.

In embodiments described herein, a modified slider body may have an increased clearance between the top plate and bottom plate, increased clearance between the top plate and bottom side rails, and/or may lack top side rails to allow passage of overlying material through the slider body as the fastener is opened and closed. This may reduce or prevent bunching or other disruptions of overlying material and provide better closure of the fastener. In some embodiments, a zipper tape may comprise teeth or coils coupled to stringers (e.g. coupled to a lower surface of the stringers) such that the stringers at least partially cover the teeth or coils. In other embodiments, a zipper tape may be coupled to the underside of overlying fabric such that one or more edges of the overlying fabric extend at least partially over teeth or coils. In embodiments, a modified slider body may accommodate a zipper tape and overlying fabric/material between the top and bottom plates such that the passage of the modified slider body along the zipper tape to close the zipper may also bring the inner edges of the overlying fabric and/or stringers together over the teeth/coils, preventing or minimizing penetration of wind and moisture through the teeth/coils.

In embodiments, a slider of a slide fastener or zipper may incorporate mechanical features configured to minimize moisture penetration through a zipper chain and/or zipper teeth. In some embodiments, water resistant coatings may be included on one or more components of the slide fastener/zipper to prevent moisture penetration through the zipper chain/teeth while still allowing normal operation of the zipper slider. In an embodiment, a moisture resistant zipper may include a slider body with increased clearance to accommodate an overlying moisture resistant layer (e.g. the garment material itself) during operation of the zipper. Some embodiments may comprise a slider body configured to allow the zipper teeth and moisture resistant layer to move through the slider body without abrading a moisture resistant coating and/or fabric or pushing the coating/fabric away during operation of the zipper. In one embodiment, a slider body may include one or more features that permit a zipper tape/teeth to be covered by a thin water resistant fabric layer. In some embodiments, a slider body may be configured to allow the slider to operate normally while allowing the water resistant fabric layer to pass through the slider body rather than being displaced by it.

FIG. 1 shows a plan view of a conventional non-invisible slide fastener assembly as generally described in the background section herein. The slide fastener assembly 1 comprises first and second rows of teeth 2 secured to respective stringers 4. Each stringer 4 is sewn onto an adjacent edge 6 of the surrounding fabric 7 at seams 8. In the illustrated example, top plate 11 of the slider body is coupled on its outer surface (away from the wearer of the garment) to a bail 12, to which is attached a pull tab 18. The pull tab 18 is used to move the slide along the first and second rows of teeth 2, uniting and separating the opposing rows of teeth.

Figure 2:
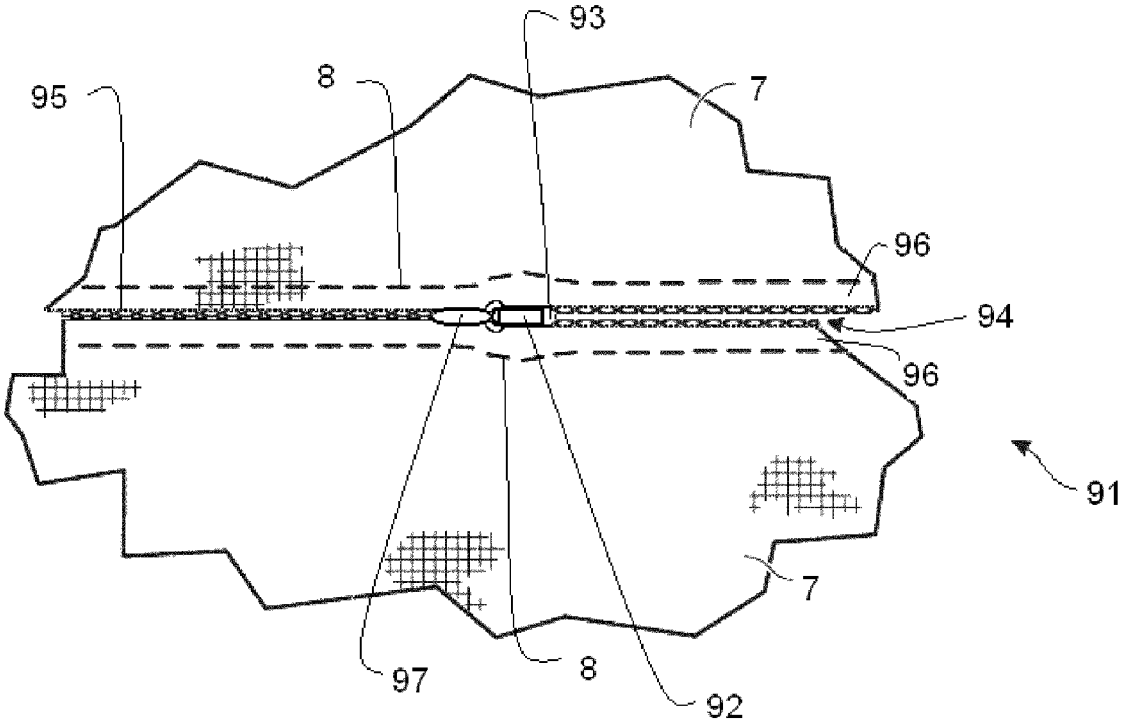
FIGURE 2 (PRIOR ART)
FIG. 2 shows a plan view of a conventional invisible slide fastener assembly.

FIG. 2 shows a plan view of a conventional invisible slide fastener assembly as generally described in the background section herein. The slide fastener assembly 91 comprises first and second rows of teeth 94 secured to respective stringers (see e.g. FIGS. 9*a*-9*c*, stringer 99). Each stringer is sewn onto an adjacent edge 96 of the surrounding fabric 7 at seams 8. The stringers are positioned below the fabric or other overlying material in order to minimize the outward appearance of the fastener. In the illustrated example, bottom plate 93 of the slider body is coupled on its outer surface (away from the wearer of the garment) to a bail 92, to which is attached a pull tab 97. The pull tab 97 is used to move the slide along the first and second rows of teeth, uniting and separating the opposing rows of teeth. When the rows of teeth are fastened together, a gap 95 remains between the adjacent edges 96 of the surrounding fabric 7 (see also FIGS. 9*a*-9*c*).

Figure 3:
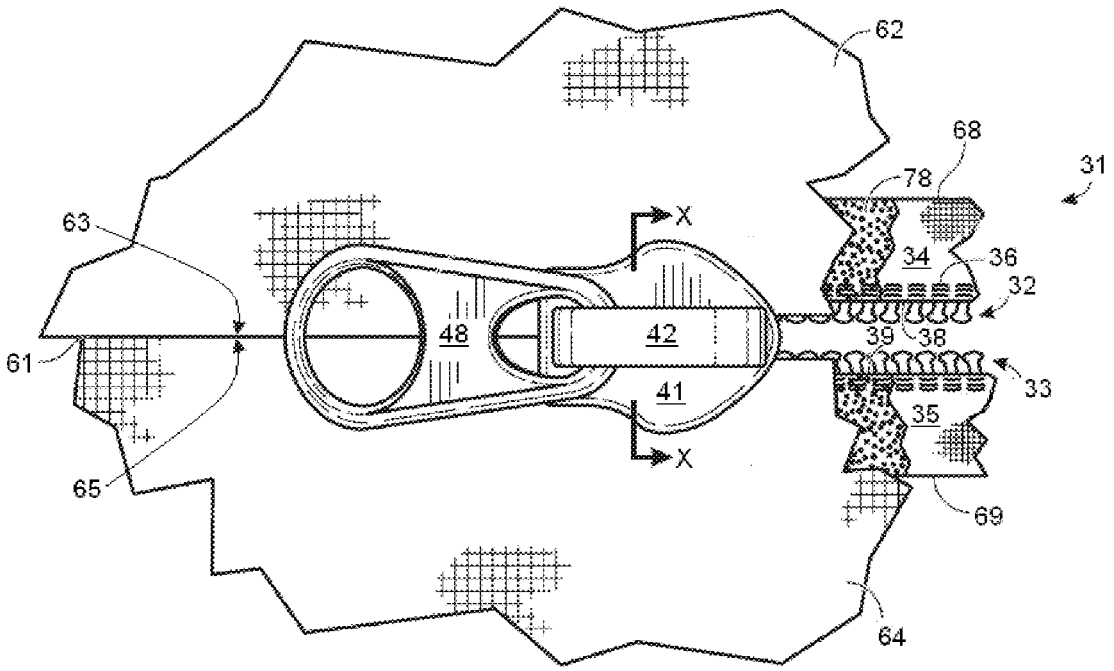
FIG. 3 shows a plan view of a weather resistant slide fastener assembly in accordance with various embodiments.

FIG. 3 shows a plan view of a weather resistant slide fastener assembly in accordance with various embodiments. As illustrated, slide fastener assembly 31 may comprise a modified slider body with a pull tab 48, a first stringer 34, a second stringer 35, a first row of teeth 32 secured to an inner edge 38 of the first stringer 34, and a second row of teeth 33 secured to an inner edge 39 of the second stringer 35. Alternatively, in some embodiments, first and second rows of teeth 32, 33 may be coupled to the undersides of first and second stringers 34, 35, respectively. In an embodiment, teeth 32, 33 may be coupled to first and second stringers 34, 35 along a portion of each stringer proximal to the inner edges 38, 39 of the stringers. For example, in one embodiment, first and second rows of teeth 32, 33 may be coupled to the undersides of stringers 34, 35 proximally to inner edges 38, 39 such that inner edges 38 and 39 meet or overlap over the first and second rows of teeth when the first and second rows of teeth are interlocked. In other embodiments, first and second rows of teeth 32, 33 may be coupled to upper surfaces of stringers 34, 35, respectively. The stringers 34, 35 and their associated rows of teeth 32, 33, respectively, may be referred to herein as a "zipper tape."

Slide fastener assembly 31 may be coupled along an upper surface to the underside of an overlying material (e.g. of an article of clothing or garment), such as a first portion 62 of the overlying material and a second portion 64 of the overlying material, by adhesive 78. Adhesive 78 may be applied to first and second stringers 34, 35 during or after manufacture of the zipper tape, and may be applied as a liquid, a sheet, by spraying, by weaving a solid adhesive into the stringers, etc. In some embodiments, a removable overlying layer may be applied over adhesive 78 to protect the adhesive until installation of the zipper tape into an article. In other embodiments, adhesive 78 may be applied instead to the underside of the article where the zipper tape is to be installed. Adhesive 78 may be a solid or semi-solid substance and heat/pressure may be applied to activate or enhance its adhesive properties. Some embodiments may lack adhesive 78. In other embodiments, adhesive 78 may be provided on both the upper and the lower surfaces of stringers to allow adhesion of the stringers between two layers of material (e.g. between an outer layer of an article and an inner lining).

First portion 62 and/or second portion 64 may be any suitable material, such as a fabric, a polymer, or any flexible or semi-flexible substance. First portion 62 and second portion 64 may be separated by a slit 61. In some embodiments, slit 61 in the overlying fabric may be created by cutting with a laser, a tool, etc., and/or may be created by aligning a lateral edge of first portion 62 with a lateral edge of second portion 64 (e.g. at or near a seam). In some embodiments, the distance between the first adjacent edge 63 and the second adjacent edge 65 of slit 61 (i.e. the width of slit 61) may be less than or equal to 0.03937 inches (i.e. 1 millimeter). In other embodiments, slit 61 may be 0.03937 inches to 0.07874 inches (1-2 millimeters) in width. The width of slit 61 may vary among embodiments and may be within the ranges of 0.003937 inches to 0.019685 inches (0.1-0.5 millimeters), 0.019685 inches to 0.059055 inches (0.5-1.5 millimeters), 0.03937 inches to 0.11811 (1-3 millimeters), 0.07874 inches to 0.15748 inches (2-4 millimeters), 0.03937 inches to 0.196851 inches (1-5 millimeters), 0.196851 inches to 0.39371 inches (5-10 millimeters), etc. In some embodiments, the width of slit 61 may vary along the length of the slit; for example, slit 61 may have a width of less than 0.007874 inches (0.2 millimeters) at its beginning and end, and may have a width of 0.007874 inches to 0.03937 inches (0.2-1.0 millimeters) at a midpoint along its length.

The first stringer 34 may be secured to an underside of first portion 62 and the second stringer 35 may be secured to second portion 64 by sewing, weaving, use of an adhesive, etc. Weather resistant slide fastener assembly 31 can be incorporated into any of various types of articles, such as garments (e.g., jackets, pants, etc.), bags, camping gear (e.g., tents, sleeping bags, back packs), and other articles, either during or after manufacture of the article. In addition, weather resistant slide fastener assembly and/or any of its components may be supplied separately for installation by an end user.

First and second portions 62, 64 in the illustrated embodiment may extend laterally (i.e., in a direction perpendicular to the length of the zipper) beyond the outer longitudinal edges 68, 69 of the first and second stringers 34, 35, respectively, forming a portion of a wall/surface of an article. In one implementation, for example, the material layer 60 can be the front of a jacket with the first and second portions 62, 64 comprising the left and right front flaps of the jacket. First and/or second portions 62, 64 may comprise a material that is used to construct the article to which the zipper is secured and may be selected to suit the needs of the intended use of the article. Accordingly, First and second portions 62, 64 can comprise any of various suitable materials, such as woven fabrics made from natural fibers (e.g., cotton or wool), woven fabrics made from synthetic fibers (e.g., nylon or polyester), or a non-woven sheet of material made from natural or synthetic materials (e.g., a sheet of rubber or polymeric material, such as polyurethane). In some embodiments, first and second portions 62, 64 may comprise a fabric layer with an outer non-fabric layer coupled to the fabric layer (e.g. by laminating, coating, spraying, melting, etc.). The non-fabric layer can be a layer of material that is impervious to water and may form a water-proof layer over the fabric. For example, the non-fabric layer can be made from any of various suitable polymers, such as polyurethane or PTFE.

In some embodiments, the first portion 62 may substantially or completely cover the first row of teeth 32 and/or the second portion 64 may substantially or completely cover the front side of the second row of teeth 33. Alternatively, or in addition, the inner edge 38 of the first stringer 34 may substantially or completely cover the first row of teeth 32 and/or the inner edge 39 of the second stringer 35 may substantially or completely cover the second row of teeth 33. Thus, when the slide fastener is closed, the front side of the zipper tape and/or the teeth may be substantially or completely covered by one or both of stringers 34, 35 and/or by one or more overlying portions 62, 64, creating a barrier against the ingress of water, moisture and wind and egress of heat through the zipper tape. In some embodiments, first portion 62 and second portion 64 may overlap when the teeth are interlocked.

In some embodiments, the stringers 34, 35 may be secured to first and second portions 62, 64 such that when the slide fastener is closed, the slit 61 between portions 62, 64 of material 60 has a width that is no greater than 0.03937 inches (1 mm). In one embodiment, the first and second adjacent edges 63, 65 of the slit 61 (defined by lateral edges of first and second portions 62, 64) may be in physical contact along part or all of their lengths when the slide fastener is closed, providing additional protection against wind and moisture. Moreover, the slide fastener assembly 31 may be mounted to under-surfaces of first and second portions 62, 64 with an adhesive, eliminating exposed seams and thereby eliminating any pathways through which water, moisture and wind might pass. The components of the slide fastener 31 can comprise any known construction and can be made from any of various suitable materials. For example, the rows of teeth 32, 33 can have a metal chain construction where metal teeth are secured (e.g., crimped) onto the stringers, a molded plastic chain construction where polymeric teeth can be fused or otherwise secured to the stringers, or a coil chain construction where "coils" of polymeric teeth are secured (e.g., sewn or woven) to the stringers. The stringers 34, 35 can be made of any suitable material, such as cotton, a cotton/polyester blend, a polymer, etc.

In some embodiments, one or more portions of first stringer 34, second stringer 35, first portion 62 and/or second portion 64 may have a surface texture, treatment, or self-adhering feature that helps to minimize the width of slit 61 between opposing edges when the zipper tape is closed. For example, the inner edge of first stringer 34 and the opposing inner edge of second stringer 35 may comprise one or more rows of hooks and eyes that cause reversible adhesion between the edges. As another example, first portion 62 and second portion 64 may comprise along their inner edges or upper/lower surfaces near the inner edges a self-clinging or self-adhering substance (e.g. a plastic, a polymer, barbed or textured thread, etc.) that encourages clinging of the inner edges, clinging of the upper surface of one portion to the lower surface of another portion, or otherwise helps to minimize the width of slit 61 between opposing edges. A self-adhering or self-clinging substance may be coated onto one or more components, woven into one or more components, sewn/glued onto one or more components, or otherwise coupled to one or more components. Alternatively, self-adhesion or self-clinging may result as a function of the surface texture of one or more components. In some embodiments, one or more portions of first stringer 34 and/or first portion 62 may comprise a generally electropositive material (e.g. wool, nylon, silk, fur) while an opposing portion of first stringer 34, second stringer 35, first portion 62 and/or second portion 64 may comprise a generally electronegative material (e.g. rubber, plastic, polyester, a polymer, etc.).

Figure 4:
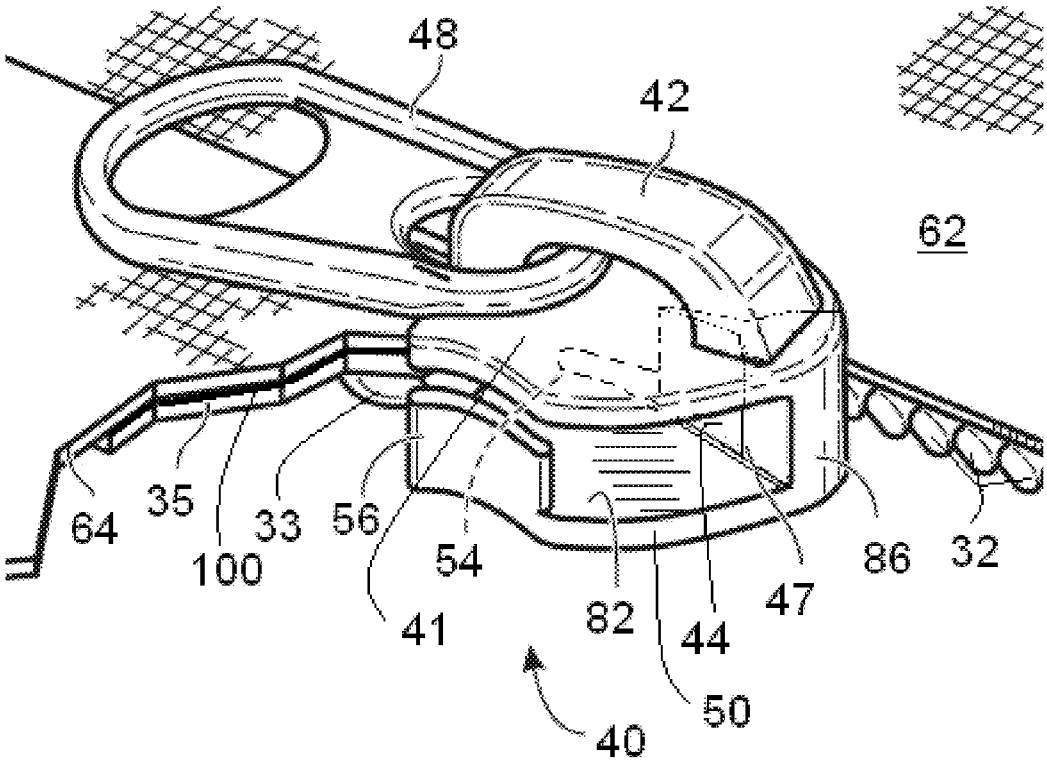
FIG. 4 shows a perspective view of a slide fastener assembly in accordance with various embodiments.

FIG. 4 shows a perspective view of a slide fastener assembly in accordance with various embodiments. This Figure shows a closer view of a weather resistant slide fastener assembly, such as the assembly of FIG. 3, with a section of second portion 64 cut away to show additional detail. As shown for second stringer 35, stringers may be coupled to the underside of an overlying layer (e.g. second portion 64) by a coupling element 100, which may comprise an adhesive (e.g. adhesive 78), a mechanical fastener, a layer formed by heating and pressing the stringer and overlying layer, or any other suitable coupling substance/element. First and second rows of teeth 32, 33 may be coupled to the undersides of first and second stringers 34, 35, respectively (see also FIG. 3, showing both stringers).

A modified slider body 40 may include a top plate 41 coupled to a bottom plate 50 by a post 47 and may have a height that is greater than the height of current zipper slide bodies in order to accommodate the outer material layer between the top plate 41 and the bottom plate 50. In embodiments, the increased height of modified slider body 40 may allow the outer material layer (e.g. first and second portions 62, 62) and/or parts of the zipper tape (e.g. first and second stringers 34, 35) to pass through the modified slider body 40 with minimal disruption or wearing of the edges. This may reduce bunching, folding, or other disruption of the outer material layer and/or parts of the zipper tape during movement of the modified slider body, allowing those features to remain relatively flat and in alignment as they are drawn together by closure of the zipper tape to reduce or eliminate exposure of the zipper teeth to wind, rain, and other external elements.

The front side of the modified slider body 40 may be defined by nose 86, which may be rounded or wedge-shaped and may separate first and second channel 80, 82 (second channel 82 shown in this view). First and second channel 80, 82 may be further separated by post 74, top control rib 44, and/or bottom control rib 54. Bottom control rib 54 may be disposed along the upper surface of bottom plate 50. As shown, top control rib 44 may extend vertically from the lower surface of top plate 41 to the upper surface of bottom plate 50. In some embodiments, post 47 may be shaped as illustrated for top control rib 44 (see e.g. FIG. 5*c*). In other embodiments, top control rib 44 may extend only along the lower surface of top plate 41 and/or may include a downward projecting feature (see e.g. FIGS. 5*d*, 6*c*, 6*d*, 12*a* and 12*b*). Bottom plate 50 may further include bottom side rails 56 extending upwardly toward top plate 41. Top plate 41 may be coupled along its upper surface to a bail 42, with a pull tab 48 coupled to bail 42.

In operation, the slide fastener may be closed by moving the modified slider body 40 in a first direction along the first and second rows of teeth 32, 33. The first row of teeth 32 may be disposed through first channel 80 while the second row of teeth 33 may be disposed through second channel 82. First and second rows of teeth 32, 33 may be guided along the interior of modified slider body 40 at least in part by bottom control rib 54, and may be pushed together between side rails 56 and/or bottom control rib 54. Pressure from bottom side rails 56 and/or bottom control rib 54 may cause the teeth of the first row to become interlocked with adjacent teeth of the second row, bringing the adjacent edges of portions 30, 32 into closer proximity and/or contact with one another. Top control rib 44 (or a similarly shaped post 47) may separate first and second adjacent edges 63, 65 of slit 61 as the first and second stringers 34, 35 and the first and second portions 62, 64 of overlying material pass through a gap between the top of the bottom side rails 56 and the underside of top plate 41. The presence of top plate 41 may prevent bunching or other disruptions of these layers, and the top control rib 44 may be shaped to minimize lateral disruption of the layers as they are parted and reunited during operation of the slide fastener. To open the slide fastener, the slide may be moved in the opposite (second) direction, which may cause the rows of teeth to separate from each other with minimal vertical/horizontal repositioning of the overlying layers. As discussed further below, modified slider body 40 may include various features permitting passage of the layers between top plate 41 and bottom plate 50 with minimal wearing, jamming, and disruption of the edges of the layers.

Figure 5A:
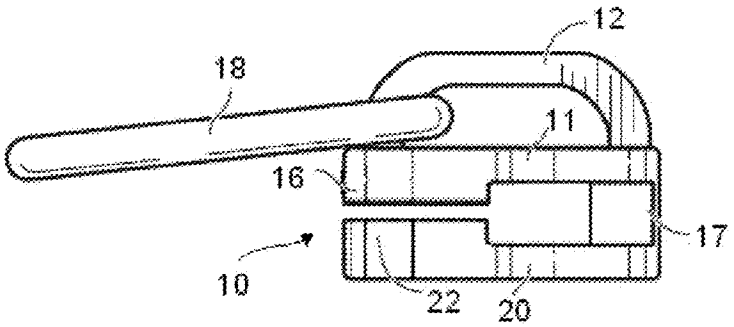
FIGURE 5a (PRIOR ART)
FIGS. 5*a* and 5*b* show side elevational views of conventional slider bodies.
Figure 5B:
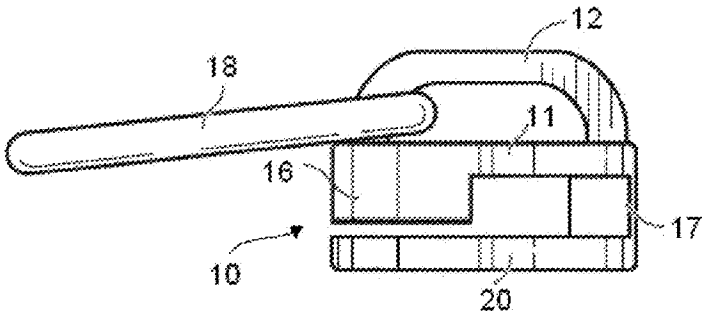
FIGURE 5b (PRIOR ART)

FIGS. 5*a* and 5*b* show side elevational views of conventional slider bodies. FIG. 5*a* shows a typical slider body 10 with a top plate 11 coupled to a bottom plate 20 via a post 17. Top plate 11 includes downwardly-projecting top side rails 16, while bottom plate 20 includes corresponding upwardly-projecting bottom side rails 22. Top plate 11 is coupled to a bail 12 for securing a pull tab 18. FIG. 5*b* shows a similar conventional slider body which differs from the slider body of 5*a* in that the bottom plate 20 lacks a side rail while the top plate 11 includes a vertically longer top side rail 16. In both of the conventional slider bodies, the gap between the top side rails 16 and the bottom side rails 22 or bottom plate 20 offers minimal clearance for the passage of layers such as stringers and/or overlying layers.

Figure 5C:
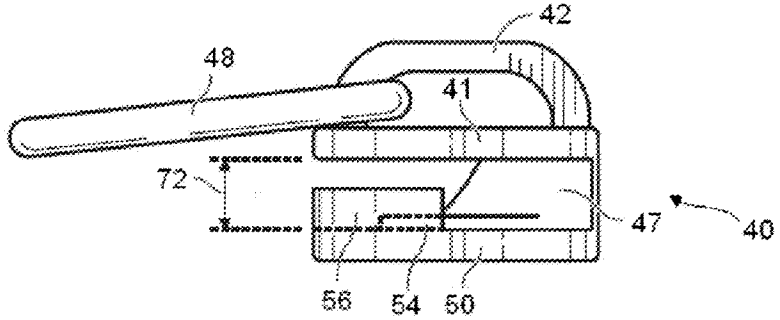
FIGS. 5*c* and 5*d* show side elevational views of modified slider bodies in accordance with various embodiments.
Figure 5D:
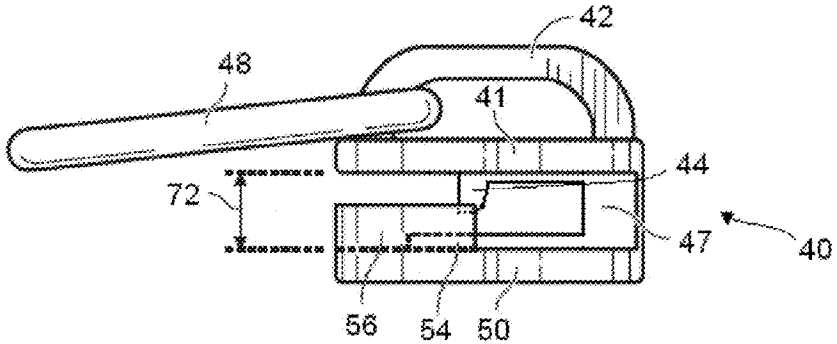

FIGS. 5*c* and 5*d* show side elevational views of modified slider bodies in accordance with various embodiments. FIG. 5*c* shows a modified slider body 40 that includes a top plate 41 and a bottom plate 50 joined by a post 47. As illustrated, post 47 may be wedge-shaped or plow-shaped and may taper at an angle from top to bottom (i.e. extending further toward the rear of the slider body at the lower end than at the upper end). This wedge or plow shape may function to part layers overlying the teeth/coils of a slide fastener. FIG. 5*d* shows an embodiment in which a top control rib 44 coupled to the lower surface of top plate 41 projects downwardly to perform this function. In both embodiments, a bottom control rib 54 may be disposed along the upper surface of bottom plate 50 as described above. Both embodiments are also shown with bottom side rails 56 and a top plate 41 that lacks side rails. In various embodiments, a first clearance 72 (defined here as the distance between the upper surface of a bottom plate and the lower surface a top plate) may be greater than the corresponding clearance of conventional slider bodies. In some embodiments, first clearance 72 may be of a sufficient height to allow stringers and/or overlying materials to pass through the slider body between the lower surface of top plate 41 and an upper edge of bottom side rails 56.

Figure 6A:
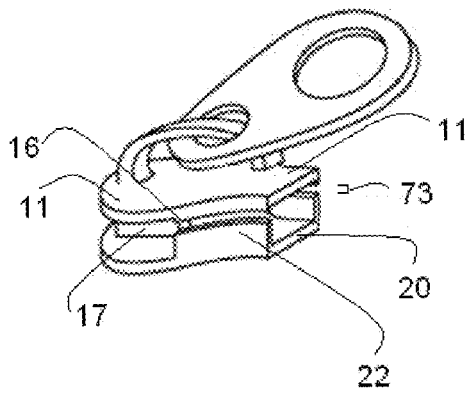
FIGURE 6a (PRIOR ART)
FIGS. 6*a* and 6*b* show perspective views of a conventional slider body.
Figure 6C:
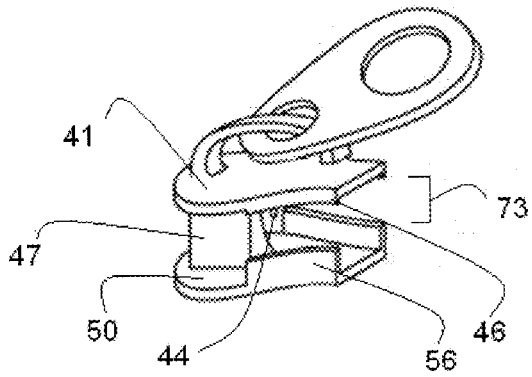
FIGS. 6*c* and 6*d* show corresponding perspective views of a modified slider body in accordance with various embodiments.
Figure 6B:
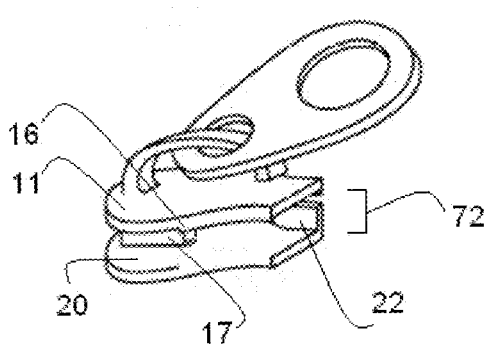
FIGURE 6b (PRIOR ART)

FIGS. 6*a* and 6*b* show perspective views of a conventional slider body. As shown, the conventional slider body includes top plate 11, with top side rails 16, a bottom plate 20 coupled to top plate 11 by a post 17, and bottom side rails 22 of bottom plate 20 projecting upwardly toward top plate 11. FIG. 6*b* shows the slider body of FIG. 6*a* with a portion of bottom plate 20 (including bottom side rail 22) cut away to show first clearance 72. FIG. 6*a* shows second clearance 73, defined here as a distance between a lower surface of a top side rail (or, in slider bodies lacking a top side rail, the lower surface of the top plate) and the upper surface of a bottom side rail (or, in slider bodies lacking a bottom side rail, the upper surface of the bottom plate). Thus, second clearance 73 is the vertical distance of a gap through which materials can pass along a generally horizontal plane through the slider body during operation of the slide fastener assembly. As shown, second clearance 73 of conventional slider bodies provides a minimal gap between side rails and the top/bottom plates.

Figure 6D:
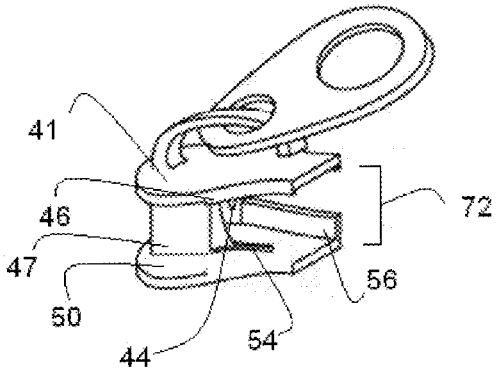

FIGS. 6*c* and 6*d* show corresponding perspective views of a modified slider body in accordance with various embodiments. As illustrated, a modified slider body may include top plate 41 with top side rails 46. In some embodiments, top plate 41 may lack top side rails 46. In other embodiments top side rails may be of minimal height, such as within the range of 0.040 to 0.200 inches or 0.200 to 0.600 inches. The height of top side rails 46 may be measured from the bottom of top side rails 46 to the upper surface of top plate 41. Alternatively, the height of top side rails 46 may be measured from the bottom of top side rails 46 to the lower surface of top plate 41. These heights are provided as examples and are not necessarily intended to be limiting. Heights of top side rails may vary among embodiments of modified slider bodies to accommodate zipper tapes of varying standard and non-standard sizes and/or various thicknesses of stringers, overlying materials, etc.

Top plate 41 may be coupled along its lower surface to a top control rib 44, which may project downwardly along some portion of the lower surface of top plate 41. Top plate 41 may be coupled to bottom plate 50 by post 47, which may be wedge- or plow-shaped as described above. Bottom plate 50 may comprise upwardly projecting bottom side rails 56. A bottom control rib 54 may be disposed along the upper surface of bottom plate 50 (see e.g. FIG. 6*d*).

As shown, first clearance 72 and/or second clearance 73 may be increased in the modified slider body as compared to conventional slider bodies. The first clearance 72 may be greater than the clearance of a conventional slider body. In an embodiment, first clearance 72 may be no less than 0.110 inches but no more than 0.128 inches greater than the thickness of an overlying layer (e.g. first portion 62 or second portion 64 of a material). In another embodiment, first clearance 72 may be no less than 0.116 inches but no more than 0.120 inches greater than the nominal thickness of the overlying layer. In some embodiments, second clearance 73 may be within the range of one-third to two-thirds of first clearance 72. In other embodiments, second clearance 73 may be substantially equal to the height of bottom side rail 56. In an embodiment, second clearance 73 may be within the range of the height of bottom side rail 56 to twice the height of bottom side rail 56. Clearance 73 may be within the range of 0.036 to 0.052 inches. Alternatively, clearance 73 may be within the range of 0.020 to 0.070 inches. For example, in one embodiment the clearance 73 may be 0.45 inches.

Bottom side rails 56 may be of any suitable height. The height of bottom side rails 56 may be measured from the lower surface of bottom plate 50 to the top of bottom side rails 56. Alternatively, the height of bottom side rails 56 may be measured from the upper surface of bottom plate 50 to the top of bottom side rails 56. The height of bottom side rails 56 may vary among zipper sizes. As an example, in a modified slider body the height of bottom side rails 56 may be within the range of 0.106 to 0.124 inches. Alternatively, the height of bottom side rails 56 may be within the range of 0.050 to 0.180 inches. In one embodiment of a modified slider body for a size 5 zipper, the height of bottom side rails 56 may be 0.115 inches. In another embodiment of a modified slider body, the height of bottom side rails 56 may be 0.115 inches and the clearance 73 may be 0.45 inches. The dimensions of bottom side rails 56, first clearance 72, second clearance 73, and/or any other components of a modified slider body may be adjusted to accommodate zipper tapes of other standard and non-standard sizes.

This increase in elevation/clearance may provide a gap suitable for allowing passage of both the zipper tape and one or more other layers (e.g. fabric, coating layer, adhesive, etc.) through the slider body during operation of the slide fastener. Increased elevation/clearance may consequently reduce mechanical wear along the edges of the layers and allow for improved sealing of gaps between edges of overlying layers, reducing or preventing entry of moisture/wind through the slide fastener. In addition, the increased elevation/clearance of the modified slider body may allow for greater ease of operation and improve the appearance of the article by minimizing the visual impact of the slide fastener.

Figure 7B:
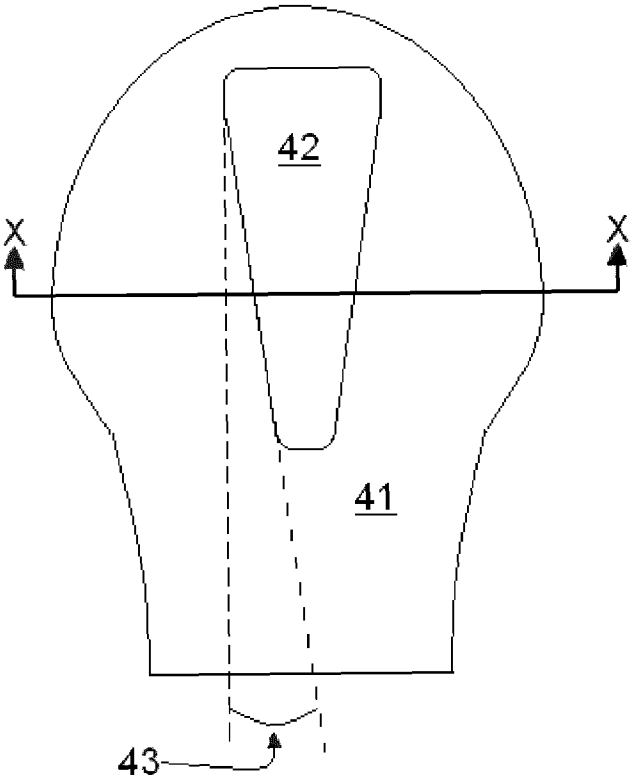
FIG. 7*b* illustrates a top view of a modified slider body in accordance with various embodiments.
Figure 7A:
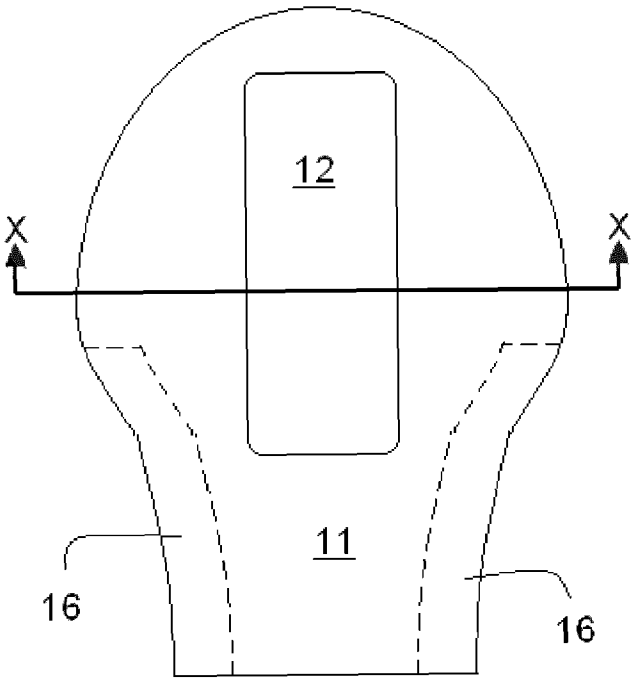
FIGURE 7a (PRIOR ART)
FIG. 7*a* illustrates a top view of a conventional slider body.

FIG. 7*a* illustrates a top view of a conventional slider body. As discussed above, a conventional slider body may include a top plate 11 with side rails 16 and a bail 12. FIG. 7*b* illustrates a top view of a modified slider body in accordance with various embodiments. As discussed above, a modified slider body may include a top plate 41 coupled to a bail 42. In some embodiments, bail 42 may be continuous with post 47, with either or both suitably shaped to minimize disruption of materials overlying the rows of teeth. The bail 42 may be used to attach an article (e.g. a pull tab, a light, a tool, a key, a clip, a fastener, a strip of fabric, etc.) to the top plate 41. As shown in FIG. 7*b*, the bail 42 (and/or post 47) may be wedge-shaped, with a taper angle 43. Taper angle 43 may be 0-15 degrees, 15-30 degrees, 30-45 degrees, 45-60 degrees, etc.

Figure 8A:
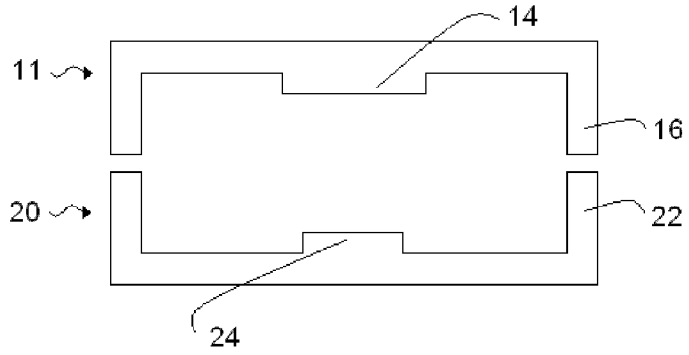
FIGURE 8a (PRIOR ART)
FIGS. 8*a* and 8*b* show sectional views of a conventional slider body taken along line X-X of FIG. 7*a;*
Figure 8B:
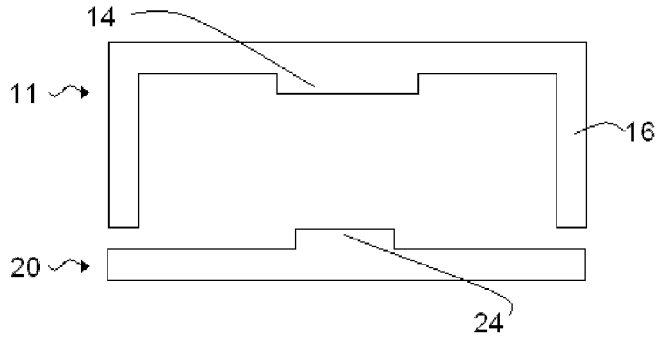
FIGURE 8b (PRIOR ART)

FIGS. 8*a* and 8*b* show sectional views of a conventional slider body taken along lines X-X of FIG. 7*a*. FIG. 8*a* shows a conventional slider body of the type also shown in FIG. 5*a*, which includes top side rails 16 and bottom side rails 22. FIG. 8*b* shows a conventional slider body of the type also shown in FIG. 5*b*, which includes top side rails 16 but lacks bottom side rails. In both, upper control rib 14 is wider than lower control rib 24.

Figure 8C:
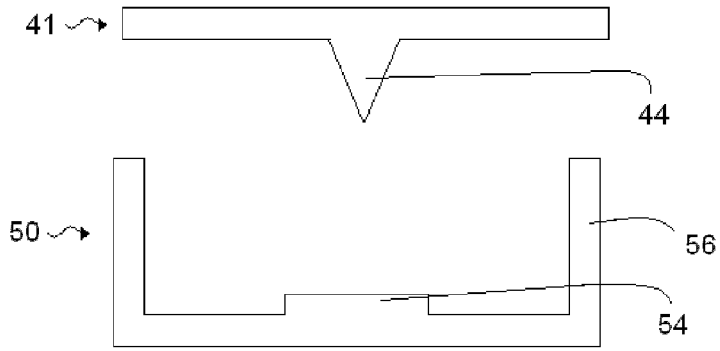
FIG. 8*c* shows a sectional view of a modified slider body taken along line X-X of FIG. 7*b*, in accordance with various embodiments.

In contrast, FIG. 8*c* shows a sectional view of a modified slider body taken along lines X-X of FIG. 7*b*, in accordance with various embodiments. FIG. 8*c* illustrates the top control rib 44 projecting downwardly from the lower surface of top plate 41, with lateral sides angled toward the center. Bottom plate 50 may include upwardly projecting side rails 56, with sufficient space between top plate 41 and bottom plate 50/bottom side rails 56 to allow passage of layers overlying the slide fastener teeth/coils. Additionally, as shown, bottom control rib 54 may be wider than one or more portions of upper control rib 44.

Figure 9A:
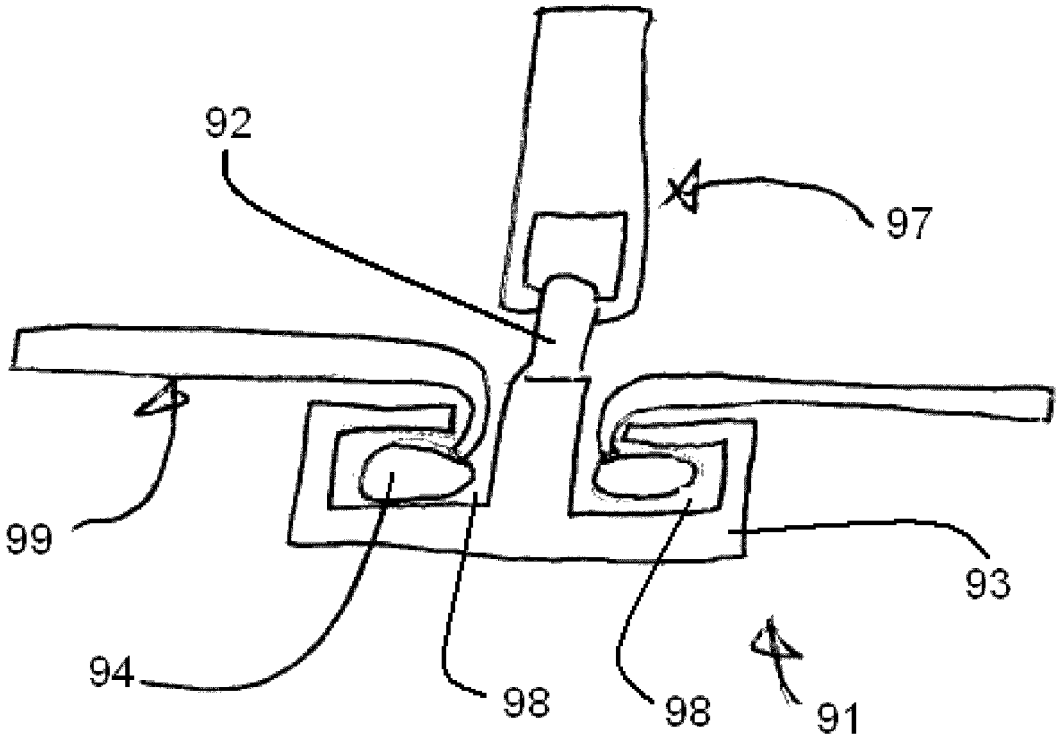
FIGURE 9a (PRIOR ART)
FIGS. 9*a*-9*c* show sectional views of a conventional invisible coil-type slide fastener assembly.
Figure 9B:
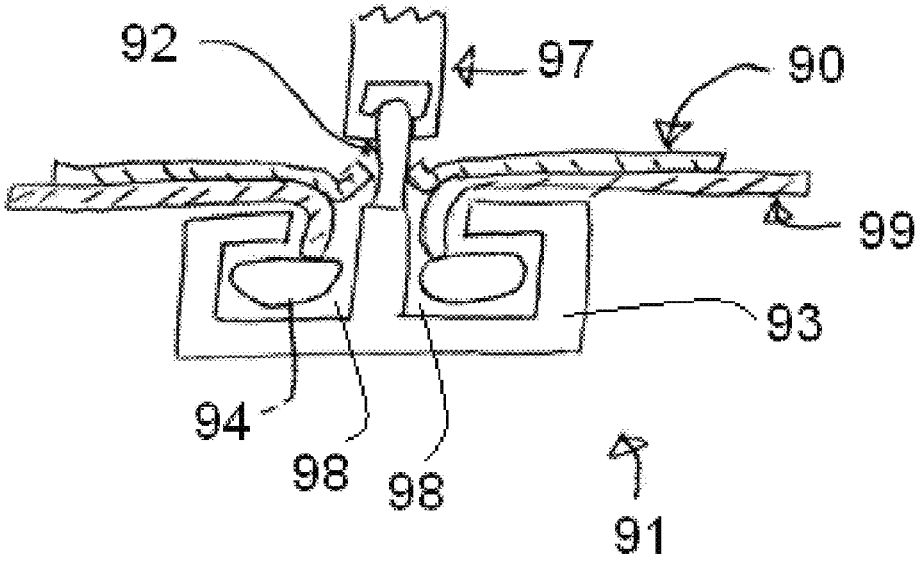
FIGURE 9b (PRIOR ART)
Figure 9C:
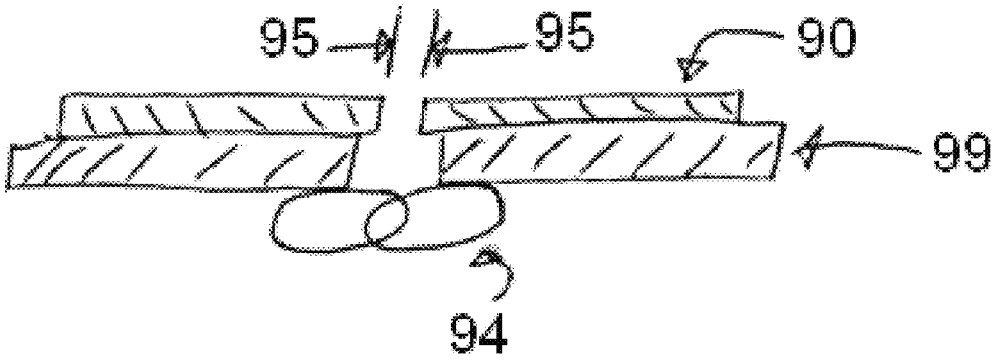
FIGURE 9c (PRIOR ART)

FIGS. 9*a*-9*c* show sectional views of a conventional invisible coil-type slide fastener assembly, such as the assembly shown in FIG. 2. FIG. 9*a* shows an invisible slide fastener assembly 91 that includes a bottom plate 93 coupled to a bail 92. Bail 92 protrudes upwardly and is coupled to a pull tab 97 for moving the slider body along the rows of teeth 94. The rows of teeth 94 are disposed along the lower edge of each stringer 99, and are shown positioned within slider body channels 98. FIG. 9*b* shows a section view of the invisible slide fastener assembly 91 with a water-resistant coating layer 90 applied over the stringers 99. The coating layer 90 is bonded to the outer surface of stringers 99, and the rows of teeth 94 are disposed along the lower edge of each stringer 99 as shown in FIG. 9*a*. FIG. 9*c* shows the rows of teeth 94 in an engaged position (i.e. with the slide fastener closed to interlock the rows of teeth). The gap 95 illustrates the gap that remains in conventional invisible slide fastener assemblies when the fasteners are closed. This gap may widen due to shrinkage of the coating layer, wear of the edges of the coating layer, and/or as a result of the cutting operation that is used to initially slit the coating layer at the time of manufacture. Further, the bail 92 causes displacement of the coating layer 90 during each operation of the slider assembly 91, resulting in delamination of the coating layer 90 from the sliders 99. This also increases the gap 95 and decreases the moisture resistance of the slide fastener due to moisture migration through the gap 95.

Figure 10:
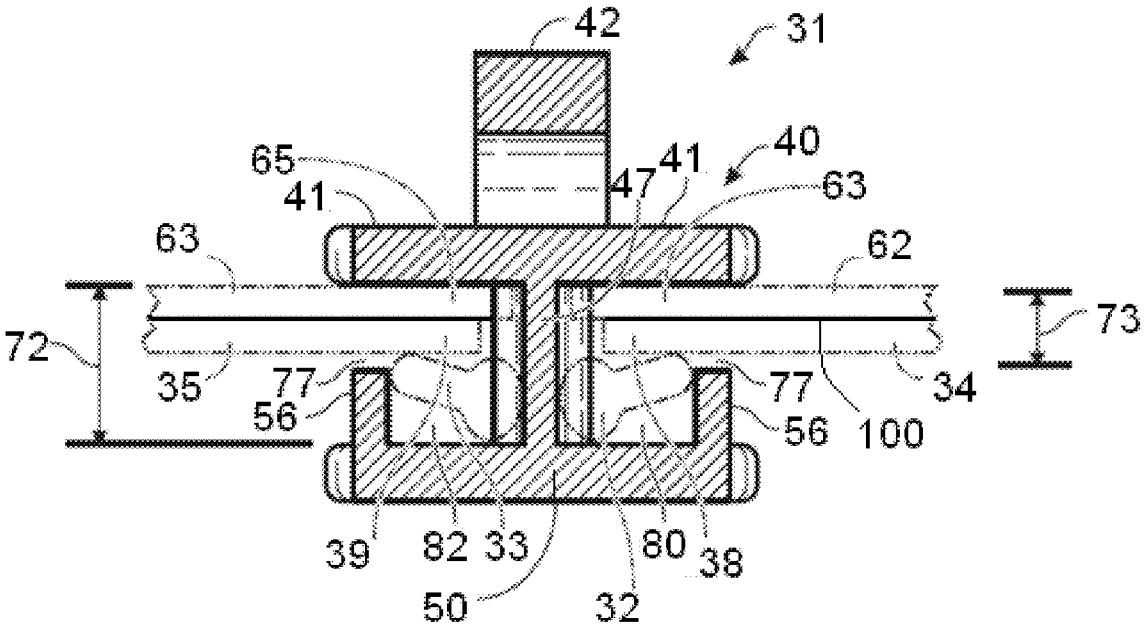
FIG. 10 shows a sectional view of a weather resistant slide fastener taken along the line X-X of FIG. 3, in accordance with various embodiments.

FIG. 10 shows a sectional view of a weather resistant slide fastener taken along the line X-X of FIG. 3, in accordance with various embodiments. The slide fastener assembly 31 may include a modified slider body 40 with a top plate 41 and a top control rib 44 coupled to the lower surface of top plate 41. Top plate 41 may be coupled to bottom plate 50 by a post 47, which may become progressively narrower toward the rear of the slide fastener. Top control rib 44 may be shaped to simultaneously separate the rows of teeth 32, 33, orient the rows of teeth 32, 33 in preparation for closure of the slide fastener, and/or separate one or more layers overlaying the stringers/rows of teeth with minimal damage or disruption to the layers. The bail 42 may be attached to the top plate 41 and may be configured for attaching a pull tab or other article to the modified slider body 40. The bottom plate 50 may comprise bottom side rails 56 for guiding and/or applying pressure to the rows of teeth 32, 33. Top control rib 44 may also apply pressure to the rows of teeth 32, 33 as they pass through the interior of the slider body to/from channels 80, 82 in order to maintain proper orientation of the teeth for separation/fastening.

As illustrated, modified slider body 40 may be configured with a first clearance 72 sufficient to accommodate multiple layers such as rows of teeth 32, 33, first and second stringers 34, 35, and first and second portions 62, 63 of overlying material. First and second portions 62, 63 may be separate portions of a single piece of material, separate pieces of material, etc. First and second portions may be portions of fabric, portions of an outer or inner wall of an article, portions of a coating layer, etc. Modified slider body 40 may be further configured with a second clearance 73 sufficient to allow passage of first and second stringers 34, 35 and first and second portions 62, 63 of overlying material through the sides of the modified slider body 40. As described above, adhesive element 100 may be disposed between the sliders and overlying material.

Modified slider body 40 may have sufficient elevation that some vertical space 77 is left unoccupied during passage of the stringers and overlying material through the sides of the slider body, decreasing mechanical wear on the stringers, the adhesive, and the overlying material during operation of the slide fastener assembly. The height of vertical space 77 may vary among embodiments. For example, in one embodiment vertical space 77 may have a height within the range of 0.004 to 0.018 inches. In other embodiments, vertical space 77 may have a height within the range of 0.001 to 0.025 inches. In various embodiments, the heights of vertical space 77, first clearance 72 and/or second clearance 73 may be adjusted to accommodate the thickness of various combinations of rows of teeth, stringers, and overlying layers in order allow the slider body to move along the rows of teeth and other layers when pulled by a user.

Figure 11:
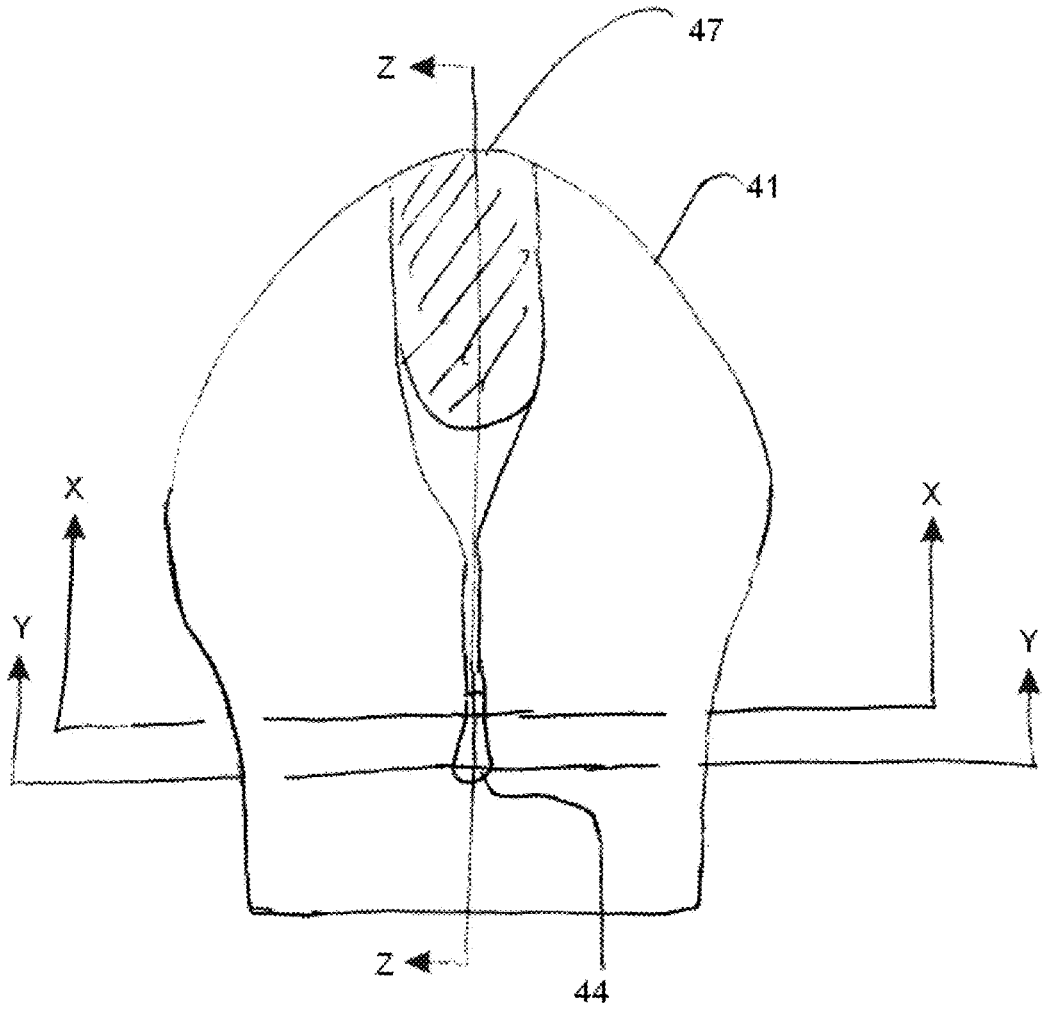
FIG. 11 illustrates a top view of a modified slider body in accordance with various embodiments.

FIG. 11 illustrates a top view of a modified slider body in accordance with various embodiments. In FIG. 11, the top plate 41 is coupled to post 47, which may have a rounded or angular/diamond shape in plan view. Top control rib 44 may extend from the post 47 toward the rear of the slider body, and may be wider at one or both ends and narrower along one or more portions along the center. In some embodiments, top control rib 44 may become progressively narrower along its length. In other embodiments, top control rib 44 may be discontinuous, and may be coupled to a lower surface of top plate 41 without being coupled to post 47 or vice versa.

Figure 12A:
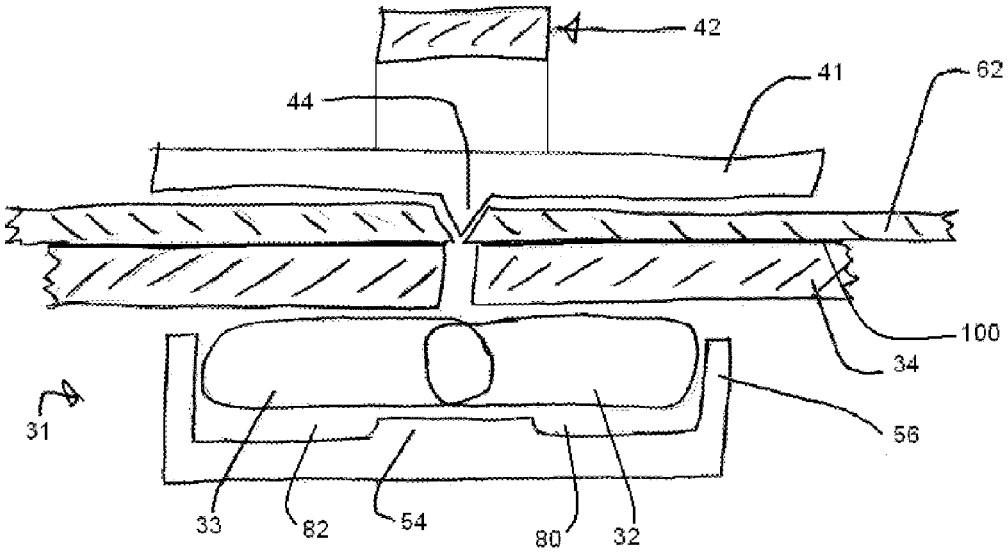
FIG. 12*a* illustrates a sectional view taken along line X-X of the modified slider body of FIG. 11, in accordance with various embodiments.

FIG. 12*a* illustrates a sectional view taken along line X-X of the modified slider body of FIG. 11, in accordance with various embodiments. As shown, first stringer 34 may be coupled to first portion 62 of overlying material by coupling element 100. In some embodiments, first portion 62 may be a water-resistant coating applied to first stringer 34. Rows of teeth 32, 33 are shown interlocked (i.e. by closure of the slide fastener) and disposed along the lower surfaces of stringers 34, 35. Top control rib 44 may be shaped to part opposing stringers and overlying layer(s), preventing these layers from becoming jammed in the slider body. The bottom control rib 54 may apply upward pressure to the rows of teeth 32, 33 while the bottom side rails 56 apply lateral inward pressure to the rows of teeth. The top control rib 44 and/or lower surface of top plate 41 may apply downward pressure to the rows of teeth. In combination, these pressures may help to join the rows of teeth 32, 33 as they pass through the slider body during closure of the slide fastener. In addition, top control rib 44 may be configured to separate opposing stringers/edges of overlying materials (e.g. portions 62, 64) along a portion of the interior of the slider body to prevent their entrapment by the teeth as the teeth are joined within the slider body.

In some embodiments, first and second portions 62, 64 may be comprised of a fabric or other material that forms the outer shell of a garment or other article. Bonding this fabric/material to the surface of the stringers may ensure that the finished garment is highly water-resistant. The modified slider body may allow a water-resistant outer garment shell, for example, to pass undisturbed through the slider body rather than being displaced by the slider body as illustrated by the conventional slider body shown in FIG. 9*b*. In some embodiments, this feature may be used to place slit pockets on the outside of a weather resistant garment without the need to cover the slits with a superfluous flap of material. The special features of the top control rib 44 and the tightly controlled distance between the inner surfaces of the top plate 41 and the bottom plate 50 through the interior of the slider body may ensure smooth operation of the slider body while preventing the snagging or jamming of the outer layer (e.g. a garment shell) and/or sliders during closure of the slide fastener.

Figure 12B:
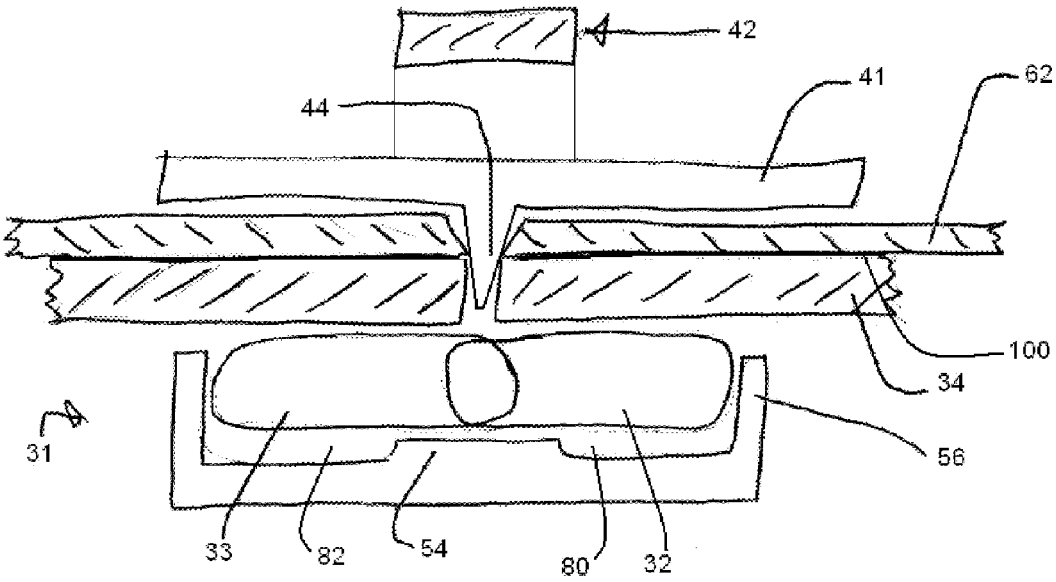
FIG. 12*b* illustrates a sectional view taken along line Y-Y of the modified slider body of FIG. 11, in accordance with various embodiments.

FIG. 12*b* illustrates a sectional view taken along line Y-Y of the modified slider body of FIG. 11, in accordance with various embodiments. Top control rib 44 may be shaped with a downward projection (see also FIGS. 6*c* and 6*d*) for parting one or more layers of fabric, stringers, etc. during operation of the slide fastener. In some embodiments, top control rib 44 may describe a continuous upward or downward slope. In other embodiments, top control rib 44 may be discontinuous, wedge-shaped, triangular, pyramidal, conical, etc., and may project generally downward at any suitable angle.

Figure 12C:
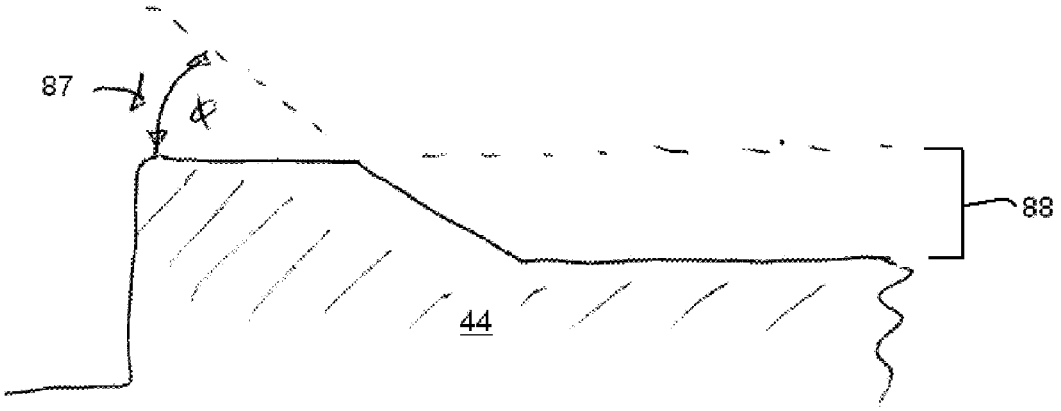
FIG. 12*c* illustrates a sectional view taken along line Z-Z of the modified slider body of FIG. 11, in accordance with various embodiments.

FIG. 12*c* illustrates a sectional view taken along line Z-Z of the modified slider body of FIG. 11, in accordance with various embodiments. In some embodiments, top control rib 44 may have a height 88 and may be set at an angle 87 as shown in the Figure, while in other embodiments top control rib 44 may comprise a continuous angle along its length. In an embodiment, the angle 87 may be within the range of 15-26 degrees. In some embodiments, the height 88 may be no less than 0.018 inches and no greater than 0.030 inches.

Figure 12D:
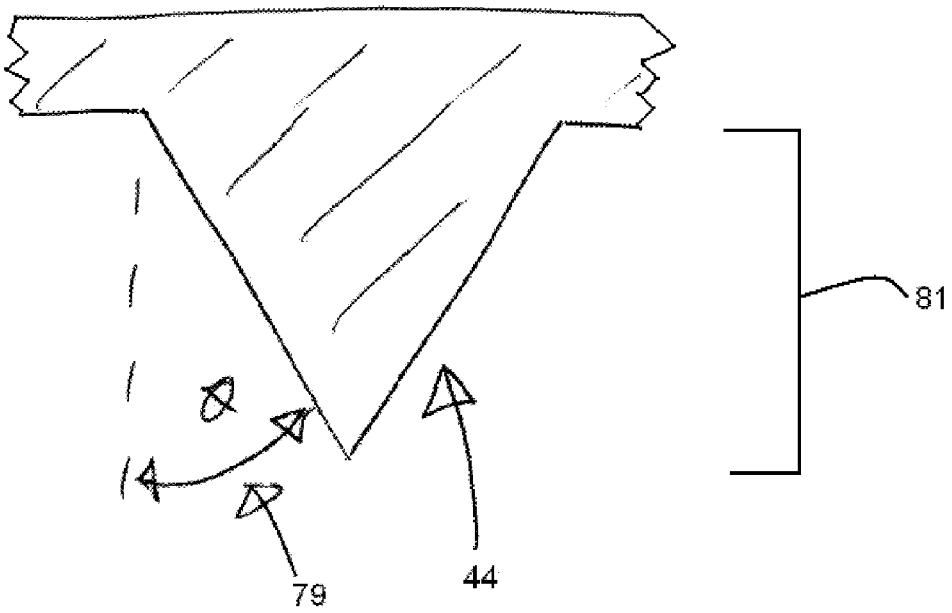
FIG. 12*d* illustrates a magnified sectional view of a top control rib as shown in FIGS. 12*a* and 12*b*, in accordance with various embodiments.

FIG. 12*d* illustrates a magnified sectional view of a top control rib as shown in FIGS. 12*a* and 12*b*, in accordance with various embodiments. As shown, top control rib 44 may have lateral sides that extend downward at an angle 79, and may have a height 81. In some embodiments, angle 79 may be no less than 30 degrees and no greater than 39 degrees. In an embodiment, the height 88 of top control rib 44 may be no less than 0.018 inches and no greater than 0.030 inches at the portion of the top control rib 44 through which line X-X passes in FIG. 11. In other embodiments, the height 88 of top control rib 44 may be no less than 0.018 inches and no greater than 0.030 inches at the portion of the top control rib 44 through which line Y-Y passes in FIG. 11.

Figure 13A:
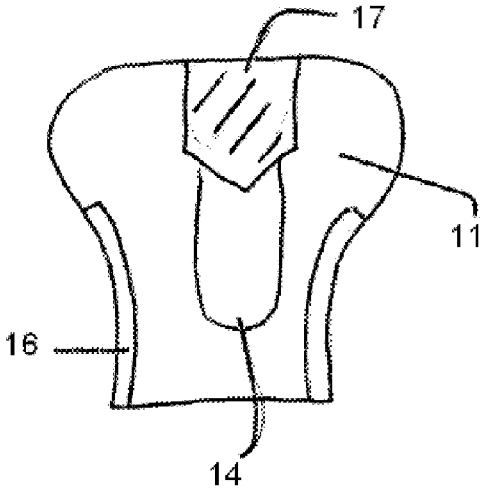
FIGURE 13a (PRIOR ART)
FIGS. 13*a* and 13*b* illustrate plan views of a conventional slider body top and a bottom plate, respectively.
Figure 13B:
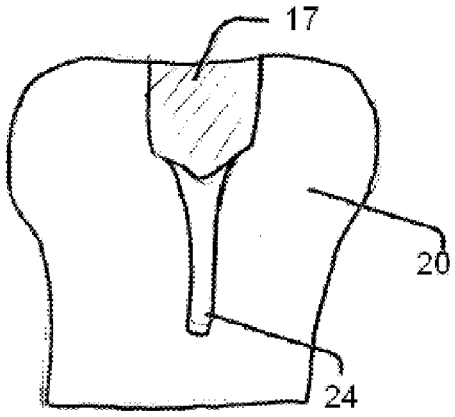
FIGURE 13b (PRIOR ART)

FIGS. 13*a* and 13*b* illustrate plan views of a conventional slider body top and a bottom plate, respectively. Top plate 11 includes top control rib and top side rails 16. Top plate 11 is coupled to bottom plate 20 by post 17, and bottom plate 20 further includes bottom control rib 24. As shown, top control rib 14 of conventional slider bodies is generally wider than bottom control rib 24.

Figure 13C:
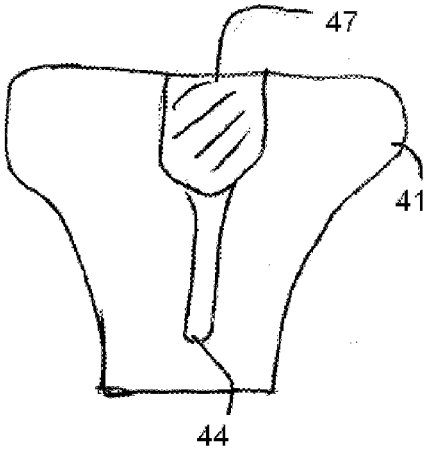
FIGS. 13*c* and 13*d* illustrate plan views of a modified slider body top and bottom plate, respectively, in accordance with various embodiments.
Figure 13D:
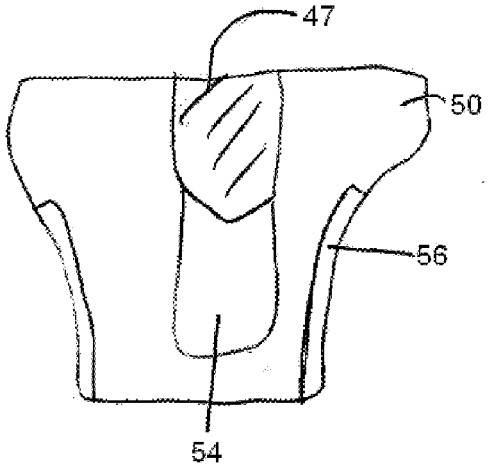

FIGS. 13*c* and 13*d* illustrate plan views of a modified slider body top and bottom plate, respectively, in accordance with various embodiments. Top plate 41 may include a top control rib 44 that is narrower than bottom control rib 54 of bottom plate 50. In addition, top plate 41 may lack side rails while bottom plate 50 is configured with bottom side rails 56. The absence of top plate side rails may allow for smooth passage of sliders and overlying materials through gaps between the upper surfaces of bottom side rails 56 and the lower surface of top plate 41, as discussed above.

Figure 14:
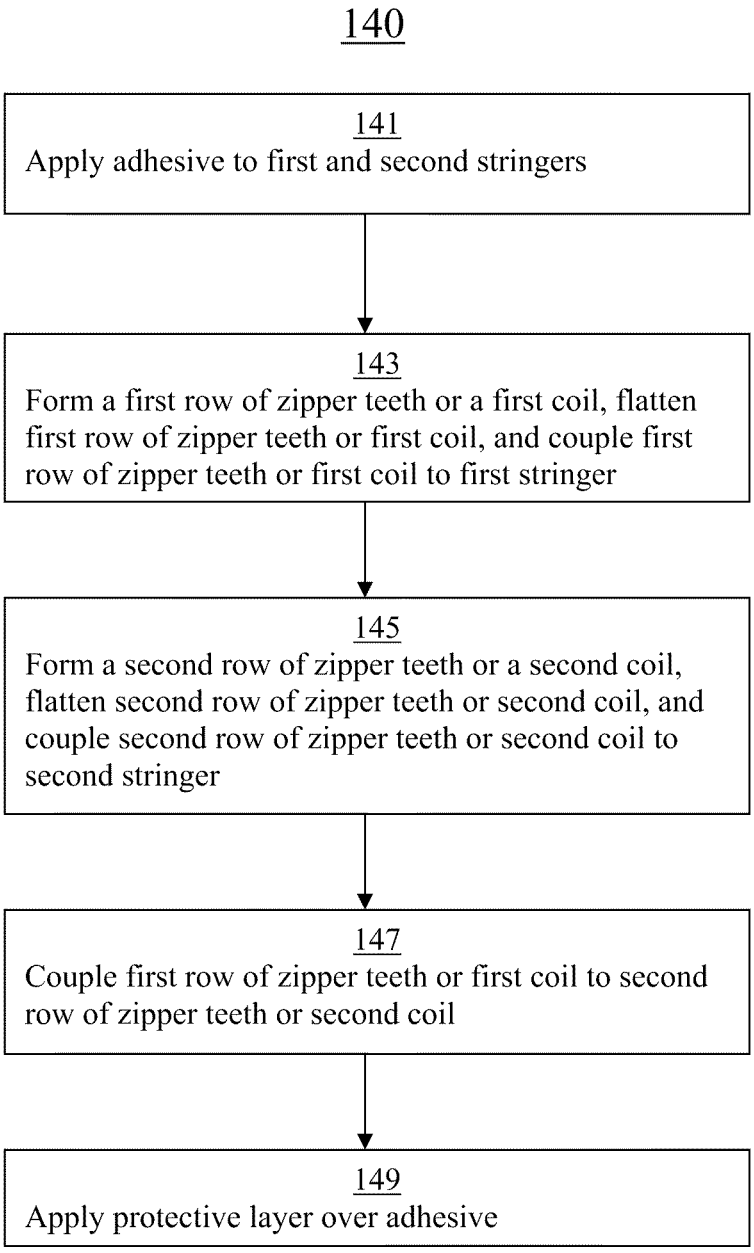
FIG. 14 illustrates a flow chart for a method of producing a zipper tape for a weather resistant slide fastener assembly, in accordance with various embodiments.

FIG. 14 illustrates a flow chart for a method of producing a zipper tape for a weather resistant slide fastener assembly, in accordance with various embodiments. Method 140 may be used for making a zipper tape comprising a first stringer, a first row of teeth secured to the first stringer, a second stringer, and a second row of teeth secured to the second stringer, wherein each of the first and the second stringer comprises an adhesive.

Method 140 may begin at block 141 with the application of adhesive to first and second stringers (e.g. first stringer 34 and second stringer 35). In embodiments, an adhesive may be a moisture-resistant and/or wind-resistant substance, or may impart one or both of these qualities to a stringer. In some embodiments, an adhesive substance in the form of a liquid/gel/semi-solid may be applied to stringers with a roller, by spraying, by dipping, or by any other suitable method. In other embodiments, a solid adhesive substance may be applied to stringers by dip coating (e.g. with a powdered solid), rolling, or other known methods of applying a solid adhesive. In an embodiment, stringers may be woven with an integrated adhesive substance that may be later heated and/or pressed to induce bonding. In some embodiments, an adhesive film may be applied to the stringers by pressing, rolling, or by any other suitable method. For example, a layer of adhesive film (e.g. coupling element 100 or adhesive 78) may be cut to match the overall size and shape of the stringers. In embodiments, adhesive film may be applied individually to individual stringers. In other embodiments, adhesive film may be applied in the form of a continuous tape to a continuous length of stringer, which may be later cut into individual stringers. Alternatively, an adhesive film or other solid/semi-solid adhesive element may be applied to opposing stringers as two separate pieces, or as a single piece with a longitudinal slit. In some embodiments, an adhesive film or other coupling element can be secured to the stringers by tack welding the film to the stringers in one, two, or more than two places.

At block 143, a first row of zipper teeth or first coil (e.g. first row of teeth 32) may be applied to the first stringer. Similarly, at block 145, a second row of zipper teeth or second coil (e.g. second row of teeth 33) may be applied to the second stringer. In some embodiments, blocks 143 and 145 may proceed simultaneously. In an embodiment, blocks 143 and 145 may further include forming the first and second rows of teeth/coils and flattening the first and second rows of teeth/coils.

At block 147, the first row of zipper teeth/first coil may be coupled to the second row of zipper teeth/second coil to form a zipper tape by any conventional method. In some embodiments block 147 may precede one or more actions of blocks 143 and/or 145. For example, the first and second rows may be joined together before they are coupled to the first and second stringers.

Blocks 143, 145 and 147 may proceed simultaneously. For example, one or more actions of blocks 143 and 145 may be performed before block 147 and another action of blocks 143 and 145 may be performed after block 147. In an embodiment, blocks 143, 145 and 147 may be performed simultaneously by forming the first and second rows of teeth/coils, flattening the first and second rows of teeth/coils, and/or coupling the first and the second rows of teeth/coils to one another before applying them to the first and second stringers. For example, the first and second rows of teeth or coils may be formed simultaneously and then joined together, and the joined rows may subsequently be coupled to the first and second stringers simultaneously. Alternatively, the first and second rows of coils may be simultaneously formed and joined by a coil machine, output as a single component comprising both rows, and subsequently coupled to the first and second stringers. In some embodiments, leading portions of the first and second rows of teeth/coils may be applied to the stringers while the lagging portions of the first and second rows of teeth/coils are being formed, flattened, and/or joined together. In other embodiments blocks 143, 145 and/or 147 may be performed at different times (i.e. discontinuously or not simultaneously). Rows of teeth/coils may be applied/coupled to the first and second stringers by any conventional method known in the art, such as by clamping, weaving, extruding, sewing/stitching, gluing, heating, etc.

At block 149, a protective layer may be applied over the adhesive. In some embodiments, the protective layer may be a paper or plastic layer that may be removed before insertion of the zipper tape into an article. Other embodiments of method 140 may lack a block 149. For example, where a solid and/or heat-activated adhesive is applied to the stringers, a protective layer may be unnecessary. In some embodiments, block 149 may be performed after block 141 and/or prior to block 143 or block 147.

Figure 15:
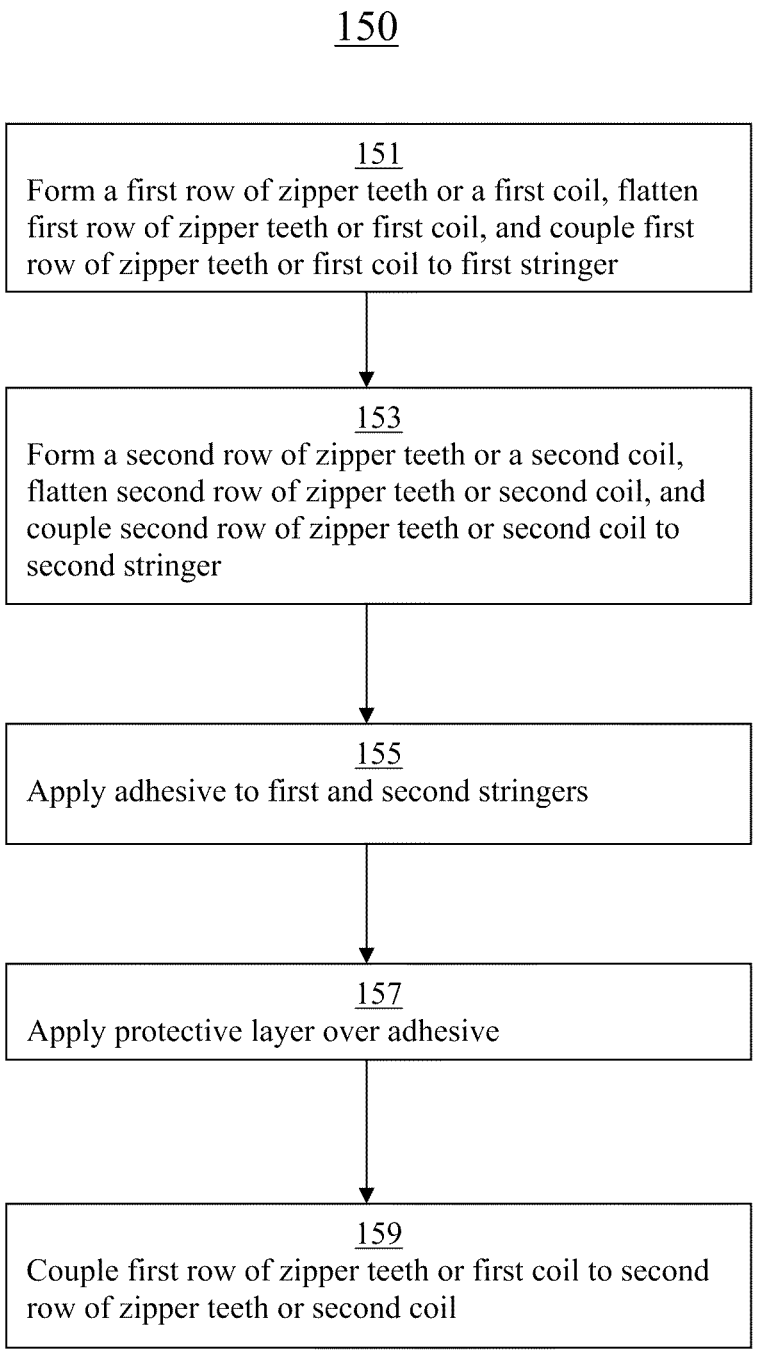
FIG. 15 illustrates a flow chart for an alternative method of producing a zipper tape for a weather resistant slide fastener assembly, in accordance with various embodiments.

FIG. 15 illustrates a flow chart for an alternative method of producing a zipper tape for a weather resistant slide fastener assembly, in accordance with various embodiments. Method 150 may be used to make a zipper tape comprising a first stringer, a first row of teeth secured to the first stringer, a second stringer, and a second row of teeth secured to the second stringer, wherein each of the first and the second stringer comprises an adhesive.

Method 150 may begin at block 151 by coupling a first row of zipper teeth or a first coil (e.g. first row of teeth 32) to a first stringer (e.g. first stringer 34). At block 153, a second row of zipper teeth or second coil (e.g. second row of teeth 33) may be coupled to a second stringer (e.g. second stringer 35). As described above for blocks 143 and 145, blocks 151 and 153 may proceed simultaneously. Blocks 151 and 153 may further include forming the first and second rows of teeth/coils and flattening the first and second rows of teeth/coils.

At block 159, the first and second rows of teeth/coils may be coupled. In some embodiments, blocks 151, 153 and 159 may proceed simultaneously.

Blocks 151, 153 and 159 may proceed simultaneously by forming the first and second rows of teeth/coils, flattening the first and second rows of teeth/coils, and coupling the first and the second rows of teeth/coils to one another before coupling the rows of teeth/coils to the stringers. The first and second rows of teeth or coils may be formed simultaneously, joined together, and then coupled to the first and second stringers simultaneously. Alternatively, the first and second rows of coils may be simultaneously formed and joined by a coil machine, output as a single component comprising both rows, and subsequently coupled to the first and second stringers. As described for method 140, leading portions of the first and second rows of teeth/coils may be applied to the stringers while the lagging portions of the first and second rows of teeth/coils are being formed, flattened, and/or joined together. In other embodiments blocks 151, 153 and/or 159 may be performed at different times (i.e. discontinuously or not simultaneously). The rows of teeth/coils may be formed, flattened, and/or coupled to the stringers in blocks 151 and 153 and subsequently coupled to one another in block 159. Coupling of teeth/coils to stringers may be performed by any conventional method as described above.

At block 155, adhesive may be applied to the stringers as described above with regard to method 140. In embodiments, an adhesive may be a moisture-resistant and/or wind-resistant substance, or may impart one or both of these qualities to a stringer. In some embodiments, a solid/semi-solid adhesive (e.g. an adhesive film) may be applied over the stringers such that a portion of the adhesive extends partially or fully over the row of teeth/coil.

At block 157, a protective layer may be applied over the adhesive as described above with regard to method 140. Some embodiments may lack a block 157.

At block 159, the first and second rows of teeth/coils may be coupled. Some embodiments may lack a block 159.

Figure 16:
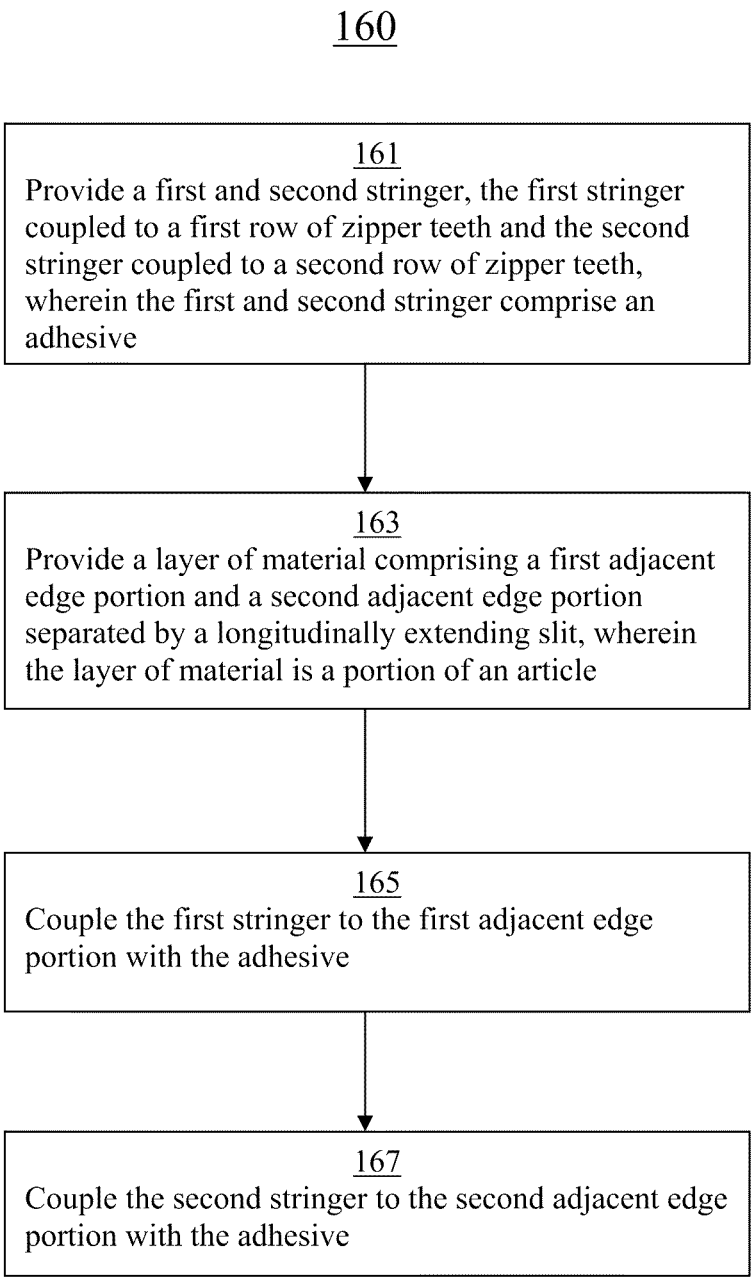
FIG. 16 illustrates a flow chart for a method of installing a weather resistant slide fastener assembly in an article, in accordance with various embodiments.

FIG. 16 illustrates a flow chart for a method of installing a weather resistant slide fastener assembly in an article, in accordance with various embodiments. Method 160 may begin at block 161 by providing a first and second stringer, the first stringer coupled to a first row of zipper teeth and the second stringer coupled to a second row of zipper teeth, wherein the first and second stringer comprise an adhesive. The first and second rows of zipper teeth may comprise teeth, a coil, etc. as described above. Zipper teeth and adhesive may be coupled to the first and second stringer as described with reference to method 140 or method 150.

At block 163, a layer of material may be provided comprising a first adjacent edge portion and a second adjacent edge portion separated by a longitudinally extending slit. The longitudinally extending slit (e.g. slit 61) may be laser cut, may be formed by a tool or instrument, or may be formed by alignment of adjacent edges of two portions of material (e.g. first and second adjacent edges 63, 65 of first and second portions 62, 64).

At block 165, the first stringer may be coupled to the first adjacent edge portion with the adhesive. At block 167, the second stringer may be coupled to the second adjacent edge portion with the adhesive. Blocks 165 and 167 may be performed simultaneously, such as during installation of a zipper tape comprising the first and the second stringer. In some embodiments, coupling the stringers to the edge portions may comprise heating and/or pressing the stringers with the corresponding adjacent edge portions. In some embodiments, coupling the stringers to adjacent edge portions may comprise positioning the adjacent edge portions of the outer layer of material to partially or completely cover each stringer, each row of zipper teeth, and/or the adhesive, such that the covered elements are not visible on the exterior of the article.

In embodiments, the coverage of stringers, zipper teeth/coils and/or adhesive by the adjacent edge portions may allow a zipper manufacturer to pre-apply adhesive film to zippers/slide fasteners for purchase by the manufacturers of articles that incorporate the zippers/slide fasteners. Thus, manufacturers of such articles can easily apply a zipper to an article without first having to cut and apply adhesive film to the zipper, as required under current manufacturing techniques. The stringers can be secured to the first and second adjacent edge portions using any suitable techniques or mechanisms.

In one embodiment, a zipper tape may be constructed by securing rows of teeth to respective stringers and securing the stringers to each other in a conventional manner. Adhesive may be applied as described above to the assembled zipper tape, which can then be placed against adjacent edge portions flanking a longitudinal slit in an outer wall of an article, then placed in a heated press. The press may be operated in a known manner to activate the adhesive under pressure and heat to couple the zipper tape to the article. Coupling the zipper tape to the outer layer of the article such that the adjacent edge portions of the outer layer completely cover each stringer allows the zipper manufacturer an opportunity to pre-apply an adhesive to the stringers of the zipper tape. Thus, the purchasers of the zipper tape (e.g., garment manufactures) can easily apply the zipper tape to an article (e.g., using a heated press) without the time-consuming steps of cutting and applying the adhesive film to the zipper tape.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A slider body comprising:

a top plate;

a bottom plate substantially parallel to the top plate, the bottom plate having lateral upwardly projecting bottom side rails, the bottom side rails having an upper surface vertically spaced from a lower surface of the top plate by a first elevational distance; and a post extending from the upper surface of the bottom plate to the lower surface of the top plate, the post to facilitate closing of a zipper when the slider body is moved in a first direction and opening of the zipper when the slider body is moved in a second direction opposite the first direction; and a downwardly projecting top control rib that extends from the lower surface of the top plate and is disposed in the second direction from the post, wherein the downwardly projecting top control rib includes an edge or face that is disposed at an angle away from the lower surface of the top plate to provide a gap between the post and the top control rib in the second direction that is longer at a lower portion of the top control rib than at an upper portion of the top control rib, wherein the slider body is configured to accommodate passage of a zipper tape and an overlying layer in a slot defined by a space between the top plate and the upper surface of the bottom side rails, and wherein the downwardly projecting top control rib extends into the slot and is configured to separate first and second portions of the overlying layer to facilitate opening or closing of the zipper by the slider body.

2. The slider body of claim 1, wherein the bottom plate further comprises a bottom control rib disposed along the upper surface of the bottom plate, the bottom control rib dividing a portion of the upper surface of the bottom plate into a first channel and a second channel.

3. The slider body of claim 1, wherein the first elevational distance is within the range of 0.036 inches to 0.052 inches.

4. The slider body of claim 1, wherein a second elevational distance from the bottom surface of the top plate to the top surface of the bottom plate is within a range of 1.5 to 3 times the first elevational distance.

5. The slider body of claim 4, wherein the bottom side rails have a height within the range of 0.106 inches to 0.124 inches.

6. The slider body of claim 4, wherein the first elevational distance is within the range of the height of the bottom side rail to twice the height of the bottom side rail.

7. The slider body of claim 1, wherein at least one side of the top control rib projects downwardly at an angle of approximately 30 to 39 degrees.

8. The slider body of claim 1, wherein the edge or face of the top control rib projects downwardly at an angle of approximately 15 to 26 degrees away from the post.

9. The slider body of claim 1, wherein the top control rib has a height of 0.018 inches to 0.030 inches.

10. The slider body of claim 1, wherein the top plate includes downwardly projecting slide rails.

11. The slider body of claim 1, wherein the top control rib further includes a side angle on a side of the top control rib.

12. A slider body comprising:

a top plate;

a bottom plate substantially parallel to the top plate, the bottom plate having lateral upwardly projecting bottom side rails, the bottom side rails having an upper surface vertically spaced from a lower surface of the top plate by a first elevational distance; and a post extending from the upper surface of the bottom plate to the lower surface of the top plate, the post to facilitate closing of a zipper when the slider body is moved in a first direction and opening of the zipper when the slider body is moved in a second direction opposite the first direction; and a downwardly projecting top control rib that extends from the lower surface of the top plate and is disposed in the second direction from the post, wherein the downwardly projecting top control rib includes an edge or face that is disposed at an angle away from the lower surface of the top plate to provide a gap between the post and the top control rib in the second direction that is longer at a lower portion of the top control rib than at an upper portion of the top control rib wherein the slider body is configured to accommodate passage of a zipper tape and an overlying layer in a slot defined by a space between the top plate and the upper surface of the bottom side rails, wherein the downwardly projecting top control rib is configured to separate first and second portions of the overlying layer to facilitate opening or closing of a zipper by the slider body; and wherein the downwardly projecting top control rib extends downwardly past a lower boundary of the slot, the lower boundary defined by the upper surface of the bottom side rails.

13. The slider body of claim 1, wherein the top plate includes top side rails and wherein the downwardly projecting top control rib extends downwardly past the top side rails.

14. The slider body of claim 1, wherein the top plate does not include top side rails.

* * * * *